US012258830B1

(12) United States Patent
Muhammad et al.

(10) Patent No.: US 12,258,830 B1
(45) Date of Patent: Mar. 25, 2025

(54) DEGRADABLE DELIVERY DEVICES TO FACILITATE DISSOLUTION OF DEGRADABLE DOWNHOLE TOOLS

(71) Applicant: NATIONAL ENERGY SERVICES REUNITED CORPORATION, Houston, TX (US)

(72) Inventors: Moin Muhammad, Houston, TX (US); Dhiraj Dudeja, Houston, TX (US)

(73) Assignee: NATIONAL ENERGY SERVICES REUNITED CORPORATION, Houston, TX (US)

( * ) Notice: Subject to any disclaimer, the term of this patent is extended or adjusted under 35 U.S.C. 154(b) by 0 days.

(21) Appl. No.: 18/760,437

(22) Filed: Jul. 1, 2024

Related U.S. Application Data

(60) Provisional application No. 63/655,012, filed on Jun. 2, 2024.

(51) Int. Cl.
*E21B 29/02* (2006.01)
*E21B 33/129* (2006.01)
(Continued)

(52) U.S. Cl.
CPC ..... *E21B 29/02* (2013.01); *E21B 33/129* (2013.01); *E21B 47/07* (2020.05); *E21B 47/138* (2020.05); *E21B 2200/08* (2020.05)

(58) Field of Classification Search
CPC ..... E21B 47/138; E21B 33/129; E21B 29/02
See application file for complete search history.

(56) References Cited

U.S. PATENT DOCUMENTS 3,104,716 A 9/1963 Burkhardt et al.
8,584,746 B2 11/2013 Marya et al.
(Continued)

FOREIGN PATENT DOCUMENTS

AU 2011201691 4/2014
CN 220081384 11/2023

OTHER PUBLICATIONS

Ö. Kılıc, A.M. Kılıc, Recovery of salt co-products during the salt production from brine, Desalination, vol. 186, Issues 1-3, 2005, pp. 11-19, ISSN 0011-9164, https://doi.org/10.1016/j.desal.2005.05.014.

(Continued)

*Primary Examiner* — Robert E Fuller
(74) *Attorney, Agent, or Firm* — Womble Bond Dickinson (US) LLP

(57) ABSTRACT

Degradable downhole tools, including degradable frac plugs, for use in combination with degradable delivery devices. Certain degradable delivery device embodiments contain one or more chemical additives that promote the complete dissolution of the degradable downhole tool. Certain degradable delivery device embodiments additionally or alternatively contain flowable sensors designed to measure operational conditions (e.g., pressure, temperature, pH, among others) within the wellbore to monitor the dissolution treatment and wellbore conditions. Certain degradable delivery device embodiments may be inserted into cavities of the degradable downhole tool prior to the tool being deployed in the wellbore and/or flowed into position near the deployed degradable downhole tool. As such, the disclosed embodiments enable the complete dissolution of the degradable downhole tool in a predicable time window, obviating the need for complex and expensive milling operations and undesirable delays during oil and gas well completion.

20 Claims, 18 Drawing Sheets

(51) Int. Cl.
*E21B 47/07* (2012.01)
*E21B 47/12* (2012.01)

(56) References Cited

U.S. PATENT DOCUMENTS

| | | | | |
|---|---|---|---|---|
| 9,316,090 | B2 | 4/2016 | Walton et al. | |
| 10,597,965 | B2 | 3/2020 | Allen | |
| 11,359,454 | B2 | 6/2022 | Helms et al. | |
| 11,466,535 | B2 | 10/2022 | Arackakudiyil et al. | |
| 11,761,305 | B2 | 9/2023 | McCarthy et al. | |
| 2005/0199401 | A1 | 9/2005 | Patel et al. | |
| 2011/0186306 | A1* | 8/2011 | Marya | E21B 33/12 166/386 |
| 2018/0245448 | A1* | 8/2018 | Fripp | E21B 47/06 |
| 2018/0320247 | A1 | 11/2018 | Ehren et al. | |
| 2020/0080396 | A1 | 3/2020 | Subbaraman et al. | |
| 2022/0298916 | A1 | 9/2022 | Sherman et al. | |
| 2022/0364429 | A1 | 11/2022 | Burke et al. | |

OTHER PUBLICATIONS

Martin Schubert, Johann W. Regler, Frédéric Vogel, Continuous salt precipitation and separation from supercritical water. Part 2. Type 2 salts and mixtures of two salts, The Journal of Supercritical Fluids, vol. 52, Issue 1, 2010, pp. 113-124, ISSN 0896-8446, https://doi.org/10.1016/j.supflu.2009.10.003.

Chanhee Boo, Ian H. Billinge, Xi Chen, Kinnari M. Shah, and Ngai Yin Yip Environmental Science & Technology 2020 54 (14), 9124-9131, DOI: 10.1021/acs.est.0c02555.

I. Gede Wenten, Danu Ariono, Mubiar Purwasasmita, Khoirudin; Integrated processes for desalination and salt production: A mini-review. AIP Conf. Proc. Mar. 9, 2017; 1818 (1): 020065. https://doi.org/10.1063/1.4976929.

Kinnari M. Shah, Ian H. Billinge, Xi Chen, Hanging Fan, Yuxuan Huang, Robert K. Winton, Ngai Yin Yip, Drivers, challenges, and emerging technologies for desalination of high-salinity brines: A critical review, Desalination, vol. 538, 2022, 115827, ISSN 0011-9164, https://doi.org/10.1016/j.desal.2022.115827.

* cited by examiner

DEGRADABLE DELIVERY DEVICES TO FACILITATE DISSOLUTION OF DEGRADABLE DOWNHOLE TOOLS

CROSS REFERENCE TO RELATED APPLICATIONS

This application claims priority to, and the benefit of U.S. Provisional Application No. 63/655,012, filed Jun. 2, 2024, titled "DEGRADABLE DELIVERY DEVICES TO FACILITATE DISSOLUTION OF DEGRADABLE DOWNHOLE TOOLS," the disclosure of which is incorporated herein by reference in its entirety.

TECHNICAL FIELD

The present disclosure generally relates to degradable downhole tools and degradable delivery devices, as well as their methods of use in oil and gas operations. More specifically, the present disclosure relates to systems and methods for delivering chemical additives and/or flowable sensors into a wellbore to facilitate and/or monitor downhole tool dissolution treatment of degradable downhole tools, such as degradable frac plugs.

BACKGROUND

Modern oil and gas operations utilize a variety of downhole tools for drilling and completion of oil and gas wells, such as valves, liners, sleeves, nozzles, and plugs. For example, in a hydraulic fracturing (also known as "fracking") operation, one or more hydraulic fracturing plugs (also known as "frac plugs") may be used to fluidly isolate a section of a wellbore. Once isolated, the section of the wellbore may then be perforated, and hydraulic fluid and proppant pumped down the wellbore and into these perforations. Thereafter, the frac plug is removed from the wellbore to enable production of hydrocarbon. Traditionally, frac plugs are removed by a milling operation after fracking operations are complete. However, such milling operations require the use of additional downhole equipment and can result in the delay of hydrocarbon production, both of which undesirably increase the cost and complexity of well completion. Additionally, in certain cases, a frac plug may be disposed too far downhole to allow for milling equipment to be used to remove the frac plug.

One approach to resolving these issues involves the use of frac plugs that partially dissolve over time while in contact with wellbore fluids. However, because the chemical composition, temperature, and pressure of wellbore fluids can vary in different wells, it is difficult to accurately determine when such a frac plug will dissolve. For example, if a frac plug dissolves too soon, this can result in an undesirable loss of fluid isolation within the section of the wellbore being fracked, which may lead to unexpected delays and/or damage to the equipment and/or well. If a frac plug dissolves too late, then there can be undesirable delays in hydrocarbon production. Additionally, partial dissolution of such frac plugs results in undissolved fragments of the frac plug remaining within the wellbore fluid (also referred to as "mucking"), which can interfere with the normal operation of wellbore equipment (e.g., pumps, valves, etc.) and result in undesired stoppages and downtime, undesirably increasing cost and completion time.

SUMMARY

To address the aforementioned problems, embodiments disclosed herein relate to degradable downhole tools, such as degradable frac plugs, that are used in combination with degradable delivery devices. Certain embodiments of the degradable delivery devices contain one or more chemical additives that, when released into the wellbore fluid, enhance or promote the dissolution of the degradable downhole tool. Certain embodiments of the degradable delivery devices additionally or alternatively contain one or more flowable sensors that, as is or upon release from the degradable delivery device, measure operational conditions of the treated reservoir section (e.g., pressure, temperature, pH, etc.) within the wellbore to monitor a downhole tool dissolution treatment. In some embodiments, one or more of the degradable delivery devices may be inserted into cavities of the degradable downhole tool prior to the tool being deployed in the wellbore and/or may be flowed into position near the deployed degradable downhole tool. Each degradable delivery device is designed to dissolve in the wellbore fluid to release the chemical additives and/or flowable sensors contained therein to promote the complete dissolution of the degradable downhole tool and/or monitor the downhole tool dissolution treatment process. Moreover, in some embodiments, the degradable delivery devices are designed to predictably dissolve within a predetermined time window to release the chemical additives and/or flowable sensors, and the degradable downhole tool is designed to predictably dissolve within a predetermined time window upon being exposed to the chemical additives. As such, the disclosed embodiments enable the complete dissolution of the degradable downhole tool in a predicable time window, obviating the need for complex and expensive milling operations and undesirable delays during oil and gas well completion.

One such embodiment of a system or apparatus is a degradable frac plug including a first cavity configured to receive a first degradable delivery device without mechanical or adhesive attachment to the degradable frac plug, the first degradable delivery device configured to dissolve in a wellbore fluid to release a first amount of a first one or more chemical additives that promote dissolution of the degradable frac plug. The degradable frac plug includes a second cavity configured to receive a second degradable delivery device without mechanical or adhesive attachment to the degradable frac plug, the second degradable delivery device configured to dissolve in the wellbore fluid to release a second amount of a second one or more chemical additives that further promote the dissolution of the degradable frac plug. In some embodiments, the first cavity is disposed above a sealing section of the degradable frac plug and the second cavity is disposed below the sealing section of the degradable frac plug when the degradable frac plug is deployed in a wellbore. In some embodiments, the first degradable delivery device is spherical and the second degradable delivery device is cylindrical. In some embodiments, the first degradable delivery device is disposed within the first cavity in a cone section of the degradable frac plug and the second degradable delivery device is disposed within the second cavity in a shoe extension of the degradable frac plug. In some embodiments, the degradable frac plug includes a degradable cover configured to mechanically couple to the shoe extension to cover the second cavity and maintain the second degradable delivery device within the second cavity after loading, the degradable cover configured to dissolve in the wellbore fluid such that the wellbore fluid reaches and dissolves the second degradable delivery device to release the second one or more chemical additives. In some embodiments, the degradable frac plug includes a metallic shoe connected to a metallic slip and a metallic cone, and the metallic slip and the metallic shoe contain a plurality of buttons, the plurality of buttons formed from a degradable metal, a degradable ceramic material, or a degradable polymeric material. In some embodiments, the first degradable delivery device, the second degradable delivery device, or both, contain one or more flowable sensors configured to detect temperature or pressure of the wellbore fluid.

Another such embodiment is a system having a wireline assembly including a wireline, one or more perforation guns, and a setting tool, the wireline assembly communicatively connected to a controller. The system includes a degradable frac plug removably connected to the setting tool of the wireline assembly. The degradable frac plug includes a first degradable delivery device disposed within a first cavity of the degradable frac plug without mechanical or adhesive attachment to the degradable frac plug, the first degradable delivery device configured to dissolve in a wellbore fluid to release a first amount of a first one or more chemical additives that promote dissolution of the degradable frac plug. The degradable frac plug includes a second degradable delivery device disposed within a second cavity of the degradable frac plug without mechanical or adhesive attachment to the degradable frac plug, the second degradable delivery device configured to dissolve in the wellbore fluid to release a second amount of a second one or more chemical additives that further promote the dissolution of the degradable frac plug, and the first degradable delivery device, the second degradable delivery device, or both, being configured to release one or more flowable sensors configured to measure a temperature, a pressure, or both, within a treated reservoir section during a treatment operation. The system also includes the controller having a processor configured to receive the measured temperature, the measured pressure, or both, determined by the one or more flowable sensors while monitoring operational conditions within the treated reservoir section during the treatment operation. In some embodiments, each flowable sensor of the one or more flowable sensors includes: a battery to power the flowable sensor; at least one sensing element configured to measure the temperature, the pressure, or both, within the treated reservoir section during the treatment operation; a memory configured to store the measured temperature, the measured pressure, or both; and an input/output (I/O) interface configured to provide the measured temperature, the measured pressure, or both, to the controller after the flowable sensor has been extracted from the treated reservoir section. In some embodiments, the controller is configured to adjust an operational parameter of a well associated with the treated reservoir section based at least in part on the measured temperature, the measured pressure, or both, determined by one or more flowable sensors.

Another such embodiment of a system or apparatus is a downhole tool dissolution treatment kit having a package containing a set of degradable delivery devices formed from one or more degradable materials that are configured to dissolve in a wellbore fluid, each degradable delivery device containing different types or different amounts of one or more chemical additives configured to promote dissolution of a degradable downhole tool, one or more flowable sensors configured to measure an operational condition within a wellbore, or a combination thereof. In some embodiments, the set of degradable delivery devices comprises a plurality of spherical degradable delivery devices, a plurality of cylindrical degradable delivery devices, or a combination thereof, each having a respective diameter ranging from about 5 centimeters (cm) to about 8 cm. In some embodiments, each degradable delivery device of the set of degradable delivery devices is formed from one or more degradable materials, the one or more degradable materials including magnesium alloys, zinc alloys, aluminum alloys, polylactic acid (PLA), or poly (glycolic acid) (PGA). In some embodiments, the one or more chemical additives comprise ammonium chloride ($NH_4Cl$), sodium nitrite ($NaNO_2$), citric acid, acetic acid, sodium chloride (NaCl), calcium chloride ($CaCl_2$)), magnesium chloride ($MgCl_2$), potassium chloride (KCl), one or more oxidizers, one or more acids, one or more bases, or any combination thereof. In some embodiments, the operational condition comprises a temperature, a pressure, or a combination of temperature and pressure, within the wellbore. In some embodiments, the downhole tool dissolution treatment kit includes a set of instructions indicating which of the set of degradable delivery devices should be selected for a treatment operation based on a chemical composition of the degradable downhole tool, a chemical composition of the wellbore fluid, a target dissolution time to dissolve the degradable downhole tool, operational conditions within the wellbore to be measured during the treatment operation, or any combination thereof. In some embodiments, the downhole tool dissolution treatment kit includes a set of computer-implemented instructions configured to be executed by a processor of a local or remote computing system, wherein, when executing the set of computer-implemented instructions, the processor is configured to: receive input from an operator indicating an identity of the downhole tool dissolution treatment kit, a chemical composition of the degradable downhole tool, a chemical composition of the wellbore fluid, a target dissolution time to dissolve the degradable downhole tool, operational conditions within the wellbore to be measured during a treatment operation, or any combination thereof; determine, based on the received input, which of the set of degradable delivery devices of the downhole tool dissolution treatment kit should be selected for the treatment operation; and provide output to the operator indicating which of the set of degradable delivery devices should be selected from the downhole tool dissolution treatment kit for the treatment operation.

One such embodiment is a method that includes the steps of: determining a chemical composition of a degradable downhole tool; determining, based at least on the chemical composition of the degradable downhole tool, respective amounts of one or more chemical additives to effectively dissolve the degradable downhole tool within a wellbore; and preparing one or more degradable delivery devices containing the one or more chemical additives for use in dissolving the degradable downhole tool within the wellbore. In some embodiments, the method includes determining a chemical composition of a wellbore fluid, the respective amounts of the one or more chemical additives being determined based at least on the chemical composition of the degradable downhole tool and the chemical composition of the wellbore fluid. In some embodiments, the one or more chemical additives comprise ammonium chloride ($NH_4Cl$), sodium nitrite ($NaNO_2$), citric acid, acetic acid, sodium chloride (NaCl), calcium chloride ($CaCl_2$)), magnesium chloride ($MgCl_2$), potassium chloride (KCl), one or more oxidizers, one or more acids, one or more bases, or any combination thereof. In some embodiments, the degradable downhole tool comprises a degradable frac plug, a degradable valve, a degradable liner, a degradable sleeve, a degradable nozzle. In some embodiments, the method includes determining a desired dissolution time to dissolve the degradable downhole tool, wherein the respective amounts of the one or more chemical additives are determined based at least on the chemical composition of the degradable downhole tool and the desired dissolution time. In some embodiments, preparing the one or more degradable delivery devices comprises: forming the one or more degradable delivery devices from one or more degradable materials configured to dissolve in a wellbore fluid; loading the one or more degradable delivery devices with the respective amounts of the one or more chemical additives; and sealing the one or more degradable delivery devices with the respective amounts of the one or more chemical additives loaded therein. In some embodiments, preparing the one or more degradable delivery devices comprises: loading one or more flowable sensors into the one or more degradable delivery devices prior to sealing the one or more degradable delivery devices, the one or more flowable sensors being configured to measure a temperature, a pressure, or a combination of temperature and pressure, within the wellbore. In some embodiments, preparing the one or more degradable delivery devices comprises selecting one or more pre-made degradable delivery devices from a downhole tool dissolution treatment kit, the one or more pre-made degradable delivery devices each containing the respective amounts of the one or more chemical additives. In some embodiments, the method includes disposing the one or more degradable delivery devices into one or more cavities of the degradable downhole tool before disposing the degradable downhole tool within the wellbore, the one or more degradable delivery devices being configured to dissolve in a wellbore fluid to release the one or more chemical additives to promote dissolution of the degradable downhole tool. In some embodiments, at least one of the one or more degradable delivery devices is not mechanically or adhesively attached to the degradable downhole tool. In some embodiments, the method includes flowing the one or more degradable delivery devices down the wellbore to reach the degradable downhole tool within the wellbore, wherein the one or more degradable delivery devices are configured to dissolve in a wellbore fluid to release the one or more chemical additives to promote dissolution of the degradable downhole tool. In some embodiments, the one or more degradable delivery devices comprise at least two degradable delivery devices each containing a different respective amount of the same chemical additive. In some embodiments, the one or more degradable delivery devices comprise at a first degradable delivery device containing a first chemical additive and a second degradable delivery device containing a second chemical additive.

Another such embodiment is a method that includes the steps of: loading a plurality of degradable delivery devices into a plurality of cavities of a degradable frac plug, each of the plurality of cavities configured to receive a respective degradable delivery device without mechanical or adhesive attachment to the respective degradable delivery device; setting the degradable frac plug within a wellbore; activating the degradable frac plug to isolate a section of the wellbore; forming perforations and hydraulically fracturing the isolated section of the wellbore; and allowing the plurality of degradable delivery devices to dissolve in a wellbore fluid to release one or more chemical additives contained therein to promote dissolution of the degradable frac plug in a predetermined amount of time and to release one or more flowable sensors configured to measure an operational parameter within the wellbore. In some embodiments, disposing the degradable frac plug within a wellbore comprises: connecting the degradable frac plug to a setting tool of a wireline assembly; lowering the degradable frac plug and the setting tool into the wellbore; and sending control signals to the setting tool via the wireline assembly to set the degradable frac plug within the wellbore. In some embodiments, the operational parameter comprises temperature, pressure, or a combination thereof. In some embodiments, the predetermined amount of time is less than 30 minutes. In some embodiments, activating the degradable frac plug comprises flowing a frac ball down the wellbore to reach the degradable frac plug within the wellbore and isolate the section of the wellbore. In some embodiments, the frac ball is an additional degradable delivery device that is configured to dissolve in the wellbore fluid to release an additional one or more chemical additives to promote the dissolution of the degradable frac plug, to release an additional one or more flowable sensors configured to measure the operational parameter within the wellbore, or a combination thereof. In some embodiments, a first degradable delivery device of the plurality of degradable delivery devices contains a first chemical additive configured to promote the dissolution of the degradable frac plug, a second degradable delivery device of the plurality of degradable delivery devices contains a flowable sensor configured to measure the operational parameter within the wellbore, and the frac ball contains a second chemical additive configured to further promote the dissolution of the degradable frac plug. In some embodiments, a first degradable delivery device of the plurality of degradable delivery devices contains a first chemical additive configured to promote the dissolution of the degradable frac plug, a second degradable delivery device of the plurality of degradable delivery devices contains a second chemical configured to further promote the dissolution of the degradable frac plug, and the frac ball contains a flowable sensor configured to measure the operational parameter within the wellbore. In some embodiments, activating the degradable frac plug comprises activating a ball-in-place feature of the degradable frac plug within the wellbore to isolate the section of the wellbore. In some embodiments, a first degradable delivery device of the plurality of degradable delivery devices contains a first chemical additive configured to promote the dissolution of the degradable frac plug, a second degradable delivery device of the plurality of degradable delivery devices contains a flowable sensor configured to measure the operational parameter within the wellbore. In some embodiments, a first degradable delivery device of the plurality of degradable delivery devices contains a first chemical additive configured to promote the dissolution of the degradable frac plug, a second degradable delivery device of the plurality of degradable delivery devices contains a second chemical additive configured to promote the dissolution of the degradable frac plug.

Aspects and advantages of these exemplary embodiments and other embodiments, are discussed in detail herein. Moreover, it is to be understood that both the foregoing information and the following detailed description provide merely illustrative examples of various aspects and embodiments, and are intended to provide an overview or framework for understanding the nature and character of the claimed aspects and embodiments. Accordingly, these and other objects, along with advantages and features of the present disclosure, will become apparent through reference to the following description and the accompanying drawings. Furthermore, it is to be understood that the features of the various embodiments described herein are not mutually exclusive and may exist in various combinations and permutations.

BRIEF DESCRIPTION OF THE DRAWINGS

The accompanying drawings, which are included to provide a further understanding of the embodiments of the present disclosure, are incorporated in and constitute a part of this specification, illustrate embodiments of the present disclosure, and together with the detailed description, serve to explain principles of the embodiments discussed herein. No attempt is made to show structural details of this disclosure in more detail than may be necessary for a fundamental understanding of the embodiments discussed herein and the various ways in which they may be practiced. According to common practice, the various features of the drawings discussed below are not necessarily drawn to scale. Dimensions of various features and elements in the drawings may be expanded or reduced to more clearly illustrate embodiments of the disclosure.

DETAILED DESCRIPTION

Figure 1A:
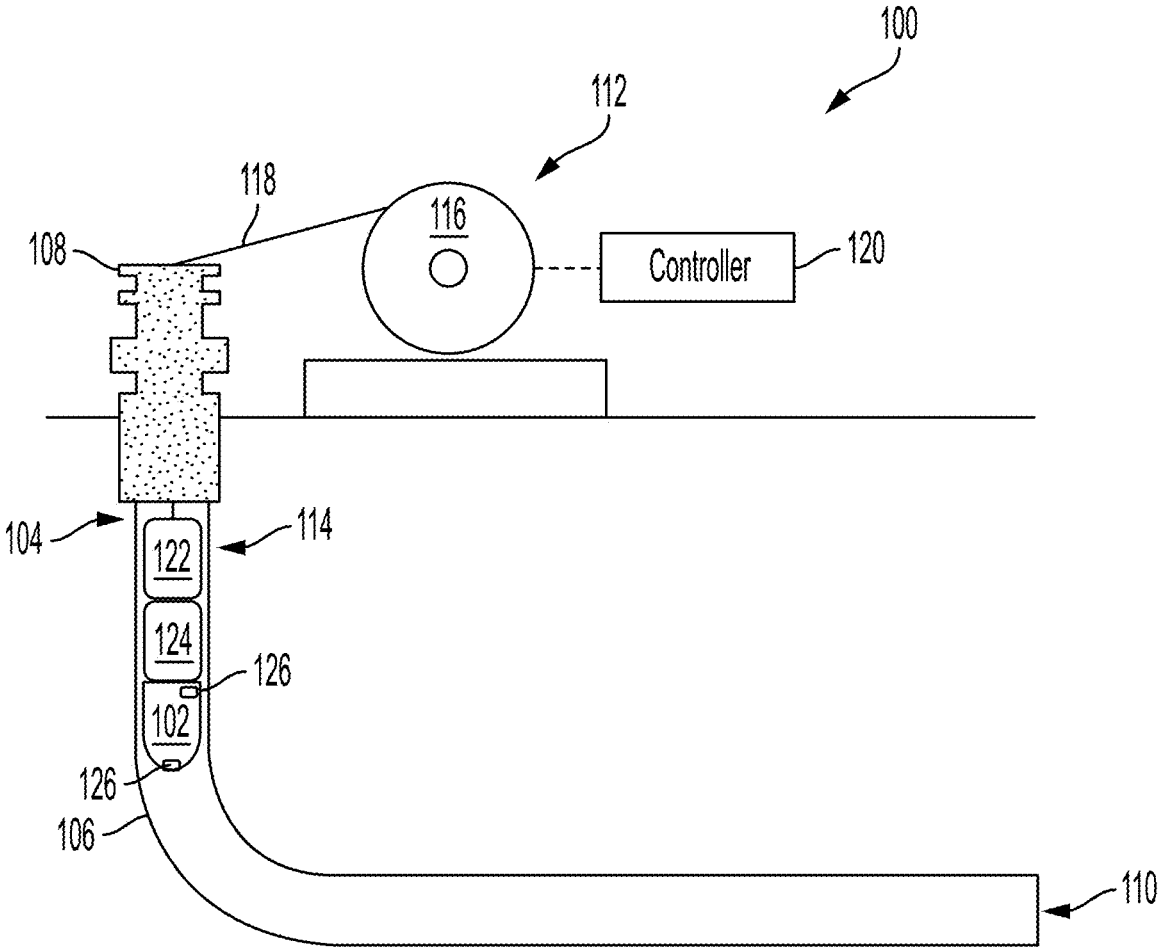
FIGS. 1A-1D are diagrammatic representations of an oil and gas well at different stages of a hydraulic fracturing operation involving a degradable frac plug, according to an embodiment.

The present disclosure describes various embodiments related to systems and methods for facilitating completion of oil and gas wells. The description may use the phrases "in certain embodiments," "in various embodiments," "in an embodiment," or "in embodiments," which may each refer to one or more of the same or different embodiments. Furthermore, the terms "comprising," "including," "having," and the like, as used with respect to embodiments of the present disclosure, are synonymous. The term "plurality" as used herein refers to two or more items or components. The terms "about" or "approximately" are defined as being close to as understood by one of ordinary skill in the art. In one non-limiting embodiment, these terms are defined to be within 10%, preferably within 5%, more preferably within 1%, and most preferably within 0.5%.

The terms "removing," "removed," "reducing," "reduced," or any variation thereof, when used in the claims and/or the specification includes any measurable decrease of one or more components in a mixture to achieve a desired result. The use of the words "a" or "an" when used in conjunction with any of the terms "comprising," "including," "containing," or "having," in the claims or the specification may mean "one," but it is also consistent with the meaning of "one or more," "at least one," and "one or more than one." The terms "wt. %", "vol. %", or "mol. %" refers to a weight, volume, or molar percentage of a component, respectively, based on the total weight, the total volume of material, or total moles, which includes the component. In a non-limiting example, 10 grams of component in 100 grams of the material is 10 wt. % of component.

FIGS. 1A-1D are diagrammatic representations of an embodiment of an oil and gas well 100 at different stages of a hydraulic fracturing operation involving a degradable frac plug 102. The illustrated oil and gas well 100 includes a wellbore 104 having a casing 106 disposed therein and coupled to a wellhead 108. While the illustrated wellbore 104 includes a substantially vertical section and a substantially horizontal section, for clarity, the term "above" is used to describe the relative position of a first component in the wellbore 104 that is disposed closer to the wellhead 108 than a second component, while the term "below" is used to describe the relative position of a first component that is disposed in the wellbore 104 farther from the wellhead 108 and closer to a terminus or toe 110 of the wellbore 104 than a second component.

For the embodiment illustrated in FIG. 1A, a wireline system 112 is being used to lower a wireline assembly 114 into the wellbore 104. The wireline system 112 includes a wireline anchor 116 that spools a wireline 118 to lower the wireline assembly 114 into the wellbore 104. A controller 120 (e.g., a controller of the wireline system 112 or another controller associated with the oil and gas well 100) is communicatively connected to the wireline 118 and the wireline anchor 116 receive operational data regarding the position and status of the wireline assembly 114, to provide suitable control signals to the wireline anchor 116 to lower the wireline assembly 114 into the wellbore 104, and to provide suitable control signals to operate the wireline assembly 114 within the wellbore 104, as discussed below. While not illustrated in FIG. 1A for simplicity, in some embodiments, the controller 120 may provide suitable control signals to other equipment (e.g., pumps, valves, other controllers) to cause hydraulic fluids to be pumped down the wellbore 104 along with the wireline assembly 114 in order to flow the wireline assembly 114 into a desired position in the wellbore 104.

For the embodiment illustrated in FIG. 1A, the wireline assembly 114 includes one or more perforation guns 122 positioned above a setting tool 124, which is in turn positioned above a degradable frac plug 102, when disposed within the wellbore 104. As such, the degradable frac plug 102 is removably connected at the distal end of the wireline assembly 114. The setting tool 124 is communicatively coupled to the controller via the wireline 118 to receive suitable control signals to explosively deploy the degradable frac plug 102 once the wireline assembly 114 is in the desired position, as discussed below. Additionally, the perforation guns 122 are communicatively connected to the controller via the wireline 118 to receive suitable control signals to explosively perforate portions of the casing 106 after the degradable frac plug 102 has been deployed, as discussed below. For the illustrated embodiment, the degradable frac plug 102 includes two cavities, each loaded with a respective degradable delivery device 126, as discussed in greater detail below.

Figure 1B:
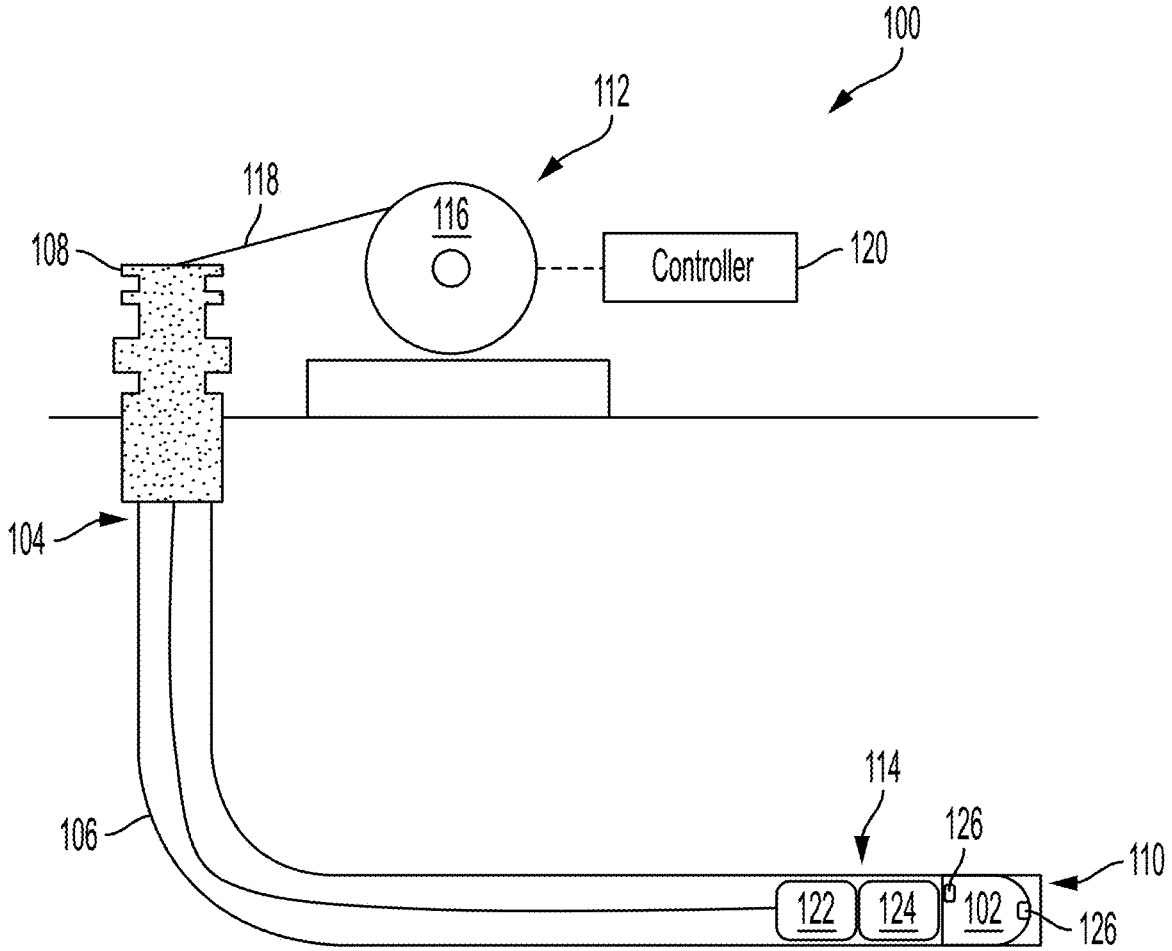

For the embodiment illustrated in FIG. 1B, the wireline assembly 114 has been lowered into the desired position within the wellbore 104 to deploy the degradable frac plug 102. As such, the controller 120 provides a suitable control signal to activate an explosive charge of the setting tool, which expands sections of the degradable frac plug 102 to seal against the interior surfaces of the casing 106. After setting the degradable frac plug 102, it is separated from the remainder of the wireline assembly 114, such that the wireline assembly 114 can be raised out of the wellbore 104. While the wireline assembly 114 is positioned at various predetermined locations within the wellbore 104, the controller 120 provides suitable control signals to activate explosive charges of the perforation guns 122 to perforate portions of the casing 106 of the wellbore 104.

For the embodiment illustrated in FIG. 1C, after the wireline assembly 114 has been removed from the wellbore 104, the deployed degradable frac plug 102 is activated by flowing a frac ball 128 down the wellbore 104 to reach a corresponding opening in the degradable frac plug 102, which fluidly isolates the section of the wellbore 104 above the degradable frac plug 102 from other sections of the wellbore 104 positioned below the degradable frac plug 102. In some embodiments, the deployed degradable frac plug 102 may be activated by a ball-in-place feature upon being deployed, which may obviate the need for the separate frac ball 128. In some embodiments, the frac ball 128 is a degradable delivery device, as discussed in greater detail below. Once the section of the wellbore 104 has been fluidly isolated, the controller 120 may provide suitable control signals to cause a hydraulic injection system 129 to activate suitable pumps, valves, and so forth, to inject hydraulic fluids and proppant 130 into the isolated section of the wellbore 104. The injected hydraulic fluids and proppant traverses the perforations 132 in the casing 106 to hydraulically fracture the surrounding geological structures.

Figure 1C:
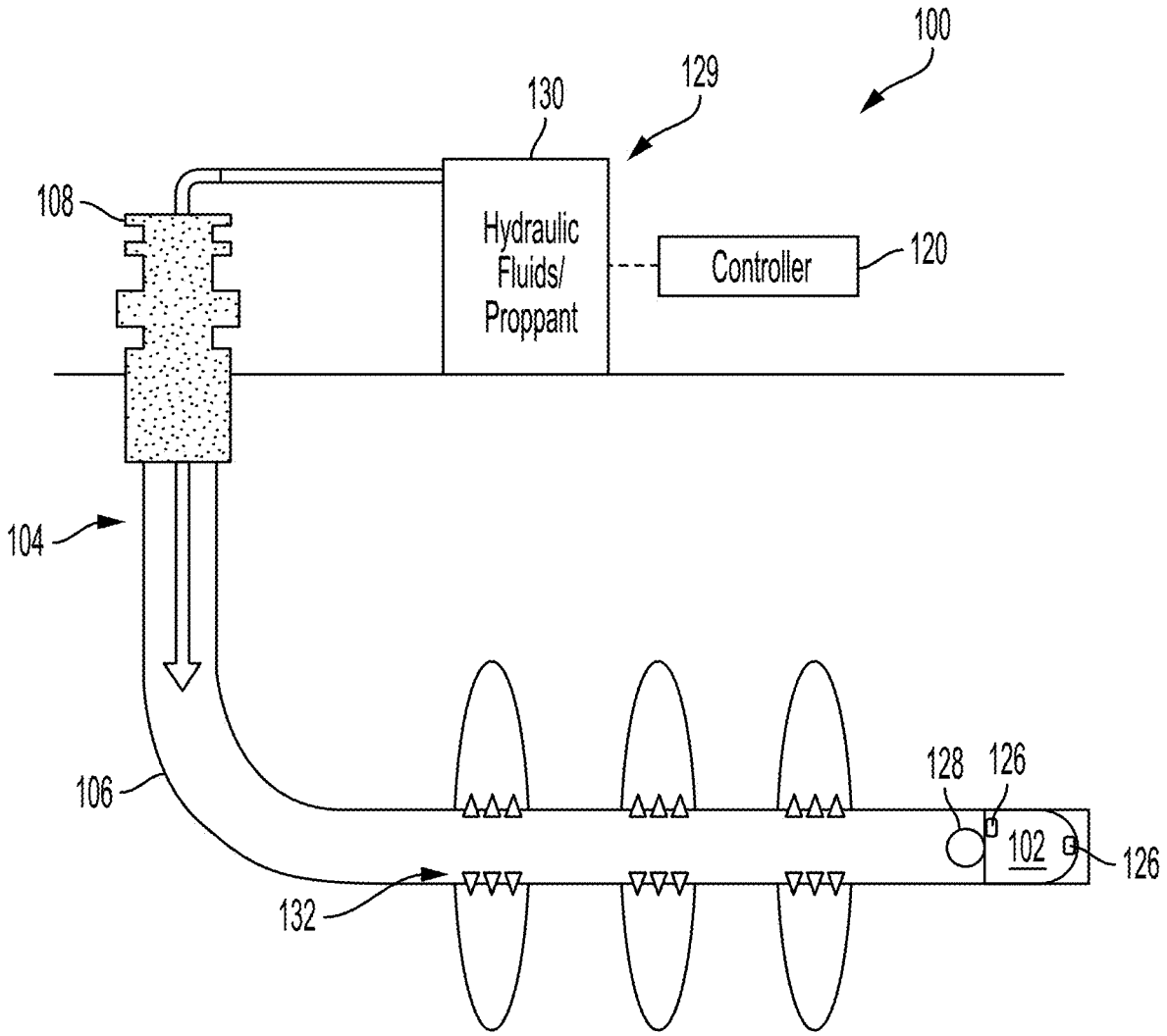

For the embodiment illustrated in FIG. 1C, the degradable frac plug 102 includes two cavities, each loaded with a respective degradable delivery device 126. Additionally, as noted, in some embodiments, the frac ball 128 may also be a degradable delivery device. At least a portion of these degradable delivery devices are designed to deliver one or more chemical additives near the degradable frac plug 102 to promote the dissolution of the degradable frac plug 102. In some embodiments, one or more of the degradable delivery devices additionally or alternatively are designed to deliver flowable sensors into the wellbore fluid that collect measurements (e.g., pressure, temperature, pH, among others) within the wellbore to monitor the dissolution of the degradable frac plug 102.

Figure 1D:
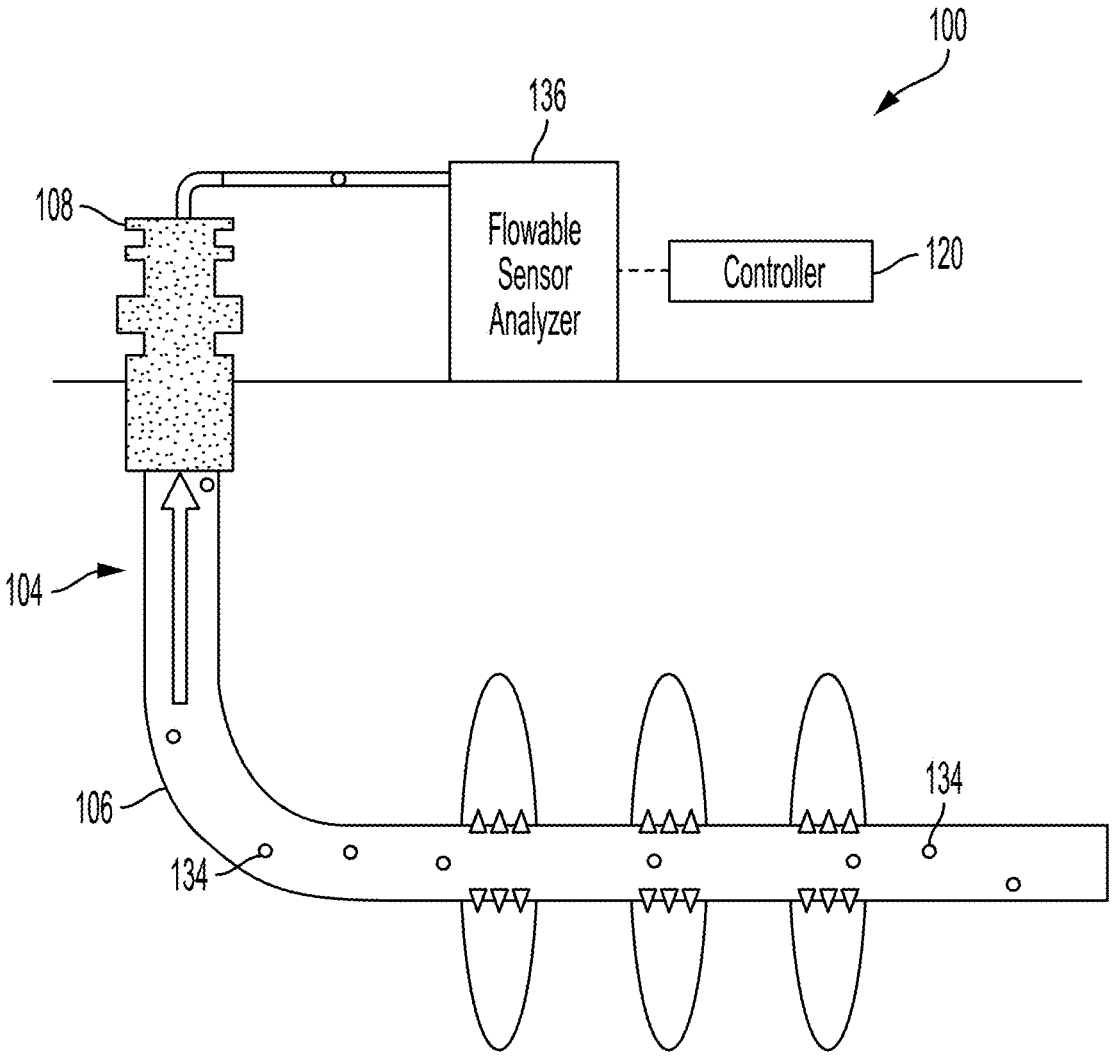

For the embodiment illustrated in FIG. 1D, promoted by the one or more chemical additives delivered by one or more of the degradable delivery devices, the degradable frac plug has completely dissolved within the wellbore, removing the fluid isolation within the wellbore 104. The wellbore fluid is pumped to the wellhead 108, or is pressurized by the produced hydrocarbons, to the reach the wellhead 108. For the illustrated embodiment, flowable sensors 134 that were released by at least one of the degradable delivery devices reach the surface, where they are collected by a flowable sensor analyzer 136 that is communicatively connected to the controller 120. The flowable sensor analyzer 136 extracts the flowable sensors 134 from the wellbore fluid, and then extracts and provides to the controller 120 the measurements collected by the flowable sensors 134 during the dissolution of the degradable frac plug 102. Based on these measurements, the controller 120 may determine whether or not the degradable frac plug 102 completely dissolved. If the controller 120 determines that the degradable frac plug 102 has not completely dissolved, the controller 120 may provide recommendations of additional actions to be performed to further promote the dissolution of the degradable frac plug 102, as discussed in greater detail below.

Figure 2:
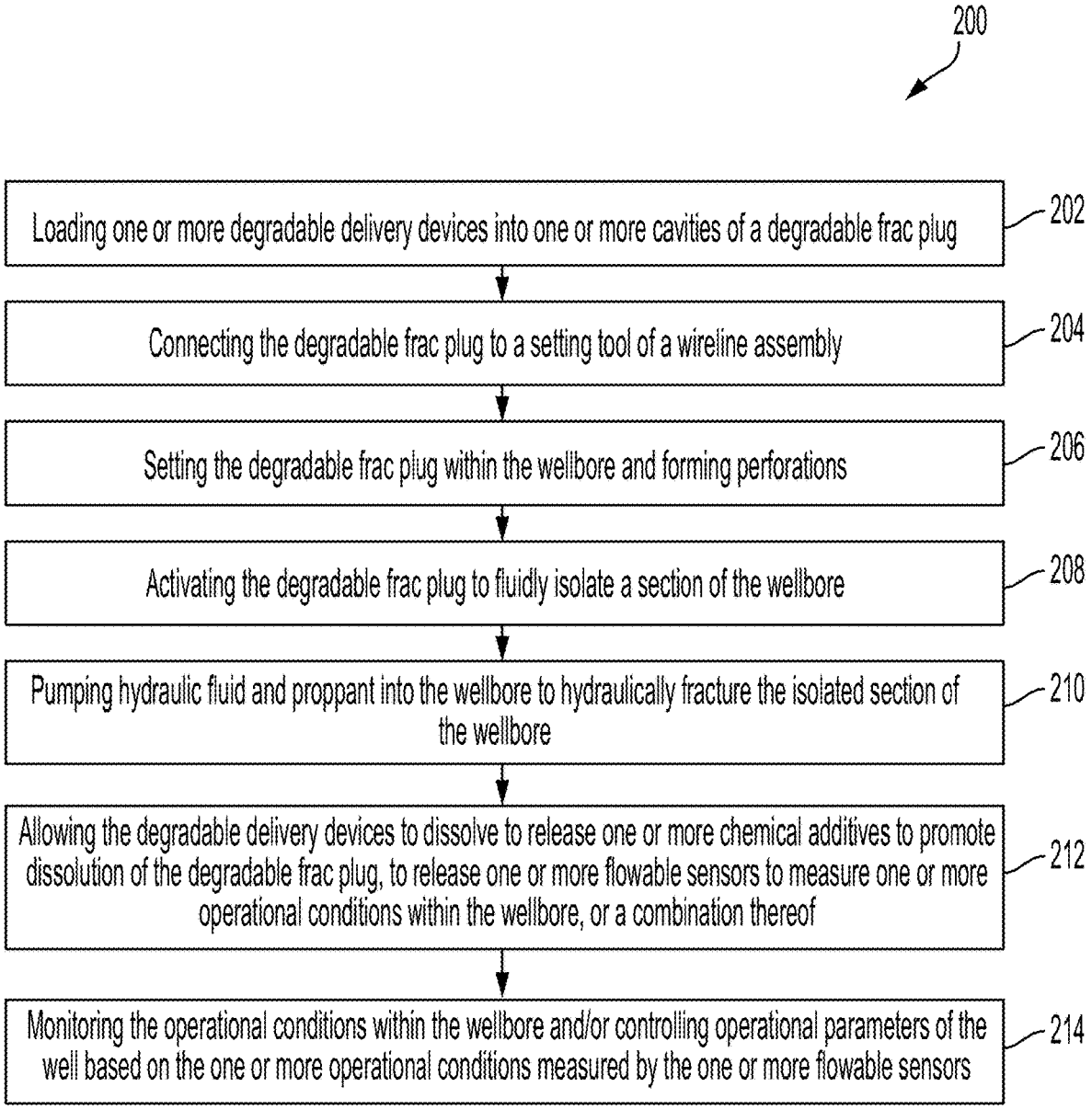
FIG. 2 is a diagrammatic representation of a method of using a degradable frac plug during a hydraulic fracturing operation, according to an embodiment.

FIG. 2 is a diagrammatic representation of an embodiment of a method 200 of using a degradable frac plug during a hydraulic fracturing operation. The illustrated method 200 is provided as an example, and in other embodiments, the method 200 may include repeated steps, omitted steps, or steps performed in other orders. In some embodiments, at least a portion of the method 200 may be stored as computer-implemented instructions stored in a memory and executed by a processor of one or more controllers to facilitate or implement the hydraulic fracturing operation.

For the embodiment illustrated in FIG. 2, the method 200 begins with the step 202 of loading one or more degradable delivery devices into one or more cavities of a degradable frac plug. For example, the one or more degradable delivery devices may be inserted into respective cavities of the degradable frac plug before or after the degradable frac plug has been attached to the setting tool of the wireline assembly, as discussed above, and before the wireline assembly is introduced into the wellbore. In some embodiments, the one or more degradable delivery devices may be preloaded into the degradable frac plug after manufacturing and before the degradable frac plug is delivered to the worksite. The degradable delivery devices are not directly mechanically or adhesively attached to the degradable frac plug, which may simplify and speed the loading of the one or more degradable delivery devices into the degradable frac plug. In some embodiments, at least two degradable delivery devices are loaded into at least two respective cavities of the degradable frac plug. Additionally, in certain embodiments, the cavities of the degradable frac plug are arranged such that at least one cavity is disposed above a sealing section and at least one cavity is disposed below the sealing section of the degradable frac plug. For such embodiments, this arrangement enables degradable delivery devices inserted into these cavities to advantageously deliver the one or more chemical additives on both sides of the sealing section of the degradable frac plug after deployment.

For the embodiment illustrated in FIG. 2, the method 200 continues with the step 204 of connecting the degradable frac plug to a setting tool of a wireline assembly. Once the wireline assembly has been lowered into and suitable positioned within the wellbore, the method continues with the step 206 of setting the degradable frac plug within the wellbore. For example, as discussed above, the controller provides suitable control signals to the setting tool of the wireline assembly via the wireline to deploy the degradable frac plug within the wellbore and to form perforations in the casing of the wellbore using the perforation guns of the wireline assembly.

For the embodiment illustrated in FIG. 2, after the degradable frac plug has been deployed within the wellbore and the perforations formed, the method 200 continues with the step 208 of activating the degradable frac plug to fluidly isolate a section of the wellbore. For example, as noted above, in some embodiments, a frac ball is flowed into position to seal against the deployed degradable frac plug and fluidly isolate the section of the wellbore above the degradable frac plug from the section(s) of the wellbore below the degradable frac plug. As noted, in some embodiments, the frac ball may also be a degradable delivery device, in addition to the one or more degradable delivery devices loaded into cavities of the degradable frac plug, and may contain one or more chemical additives to promote dissolution of the degradable frac plug, one or more flowable sensors to measure operational conditions in the wellbore while the degradable frac plug is being dissolved, or both. In some embodiments, instead of using a separate frac ball to activate the degradable frac plug, a ball-in-place feature of the frac plug may be used, which involves a degradable delivery device that is loaded into the degradable frac plug moving into position after the degradable frac plug has been deployed to fluidly isolate the section of the wellbore. The method 200 continues with the step 210 of pumping hydraulic fluid and proppant into the wellbore to hydraulically fracture the isolated section of the wellbore.

For the embodiment illustrated in FIG. 2, after the fluidly isolated section of the wellbore has been hydraulically fractured, the method 200 includes the step 212 of allowing the degradable delivery devices to dissolve releasing one or more chemical additives to promote dissolution of the degradable frac plug, releasing one or more flowable sensors to measure one or more operational conditions within the treated reservoir section of the wellbore, or a combination thereof. As noted, the degradable delivery devices may include one or more degradable delivery devices loaded into cavities of the degradable frac plug, a frac ball degradable delivery device, or any combination thereof. As discussed in greater detail below, the degradable delivery devices include a container formed from a material that dissolves in the wellbore fluid to release the one or more chemical additives, the one or more flowable sensors, or a combination of chemical additives and flowable sensors. Moreover, the respective containers of the degradable delivery devices are designed to predictably dissolve in the wellbore fluid to release their respective contents in a first predetermined amount of time after being exposed to the wellbore fluid. The chemical additive(s) released into the wellbore fluid by one or more of the degradable delivery devices promotes (e.g., accelerates, enhances) the dissolution of the degradable frac plug in a second predetermined amount of time. The first predetermined amount of time can be tuned, for example, based on the material used to construct the container of each of the degradable delivery devices, the shape and dimensions of each of the degradable delivery devices, and the chemical composition of the wellbore fluid. The second predetermined amount of time can be tuned, for example, based on the one or more chemical additives delivered by the degradable delivery devices, the chemical composition of the degradable frac plug, and the chemical composition of the wellbore fluid. As such, based on the first and second predetermined amounts of time, the controller or an operator can predictably determine the total time window needed for the degradable frac plug to completely dissolve.

For the embodiment illustrated in FIG. 2, the method 200 includes the step 214 of monitoring the operational conditions within the wellbore (e.g., within the treated reservoir section) and/or controlling operational parameters of the well based on the one or more operational conditions measured by the one or more flowable sensors. For example, as noted, in some embodiments, at least one of the degradable delivery devices includes one or more flowable sensors that, upon being released from the container of the degradable delivery device, collect measurements of operational conditions (e.g., pressure, temperature, pH, etc.) within the wellbore as the degradable frac plug is being dissolved. Once these flowable sensors are retrieved from the wellbore fluid at the surface, these measurements are collected and analyzed to determine whether the degradable frac plug was successfully dissolved. In some embodiments, these measurements are provided to the controller for analysis to determine if the complete dissolution of the degradable frac plug was successful within the predetermined time window. Responsive to the controller determining that the dissolution of the degradable frac plug was unsuccessful, the controller may modify operation of equipment associated with the well in response, in certain embodiments. In other embodiments, the controller may instead output recommendations to the operator regarding additional degradable delivery devices that can be flowed into position near the degradable frac plug to accelerate or complete the dissolution process. In some embodiments, the controller may collect the measurements from the flowable sensors, in addition to other parameters related to the dissolution treatment of the degradable frac plug, and use this data to update recommendations of degradable delivery devices, degradable frac plugs, and chemical additives to be used in future hydraulic fracturing operations.

Figure 3:
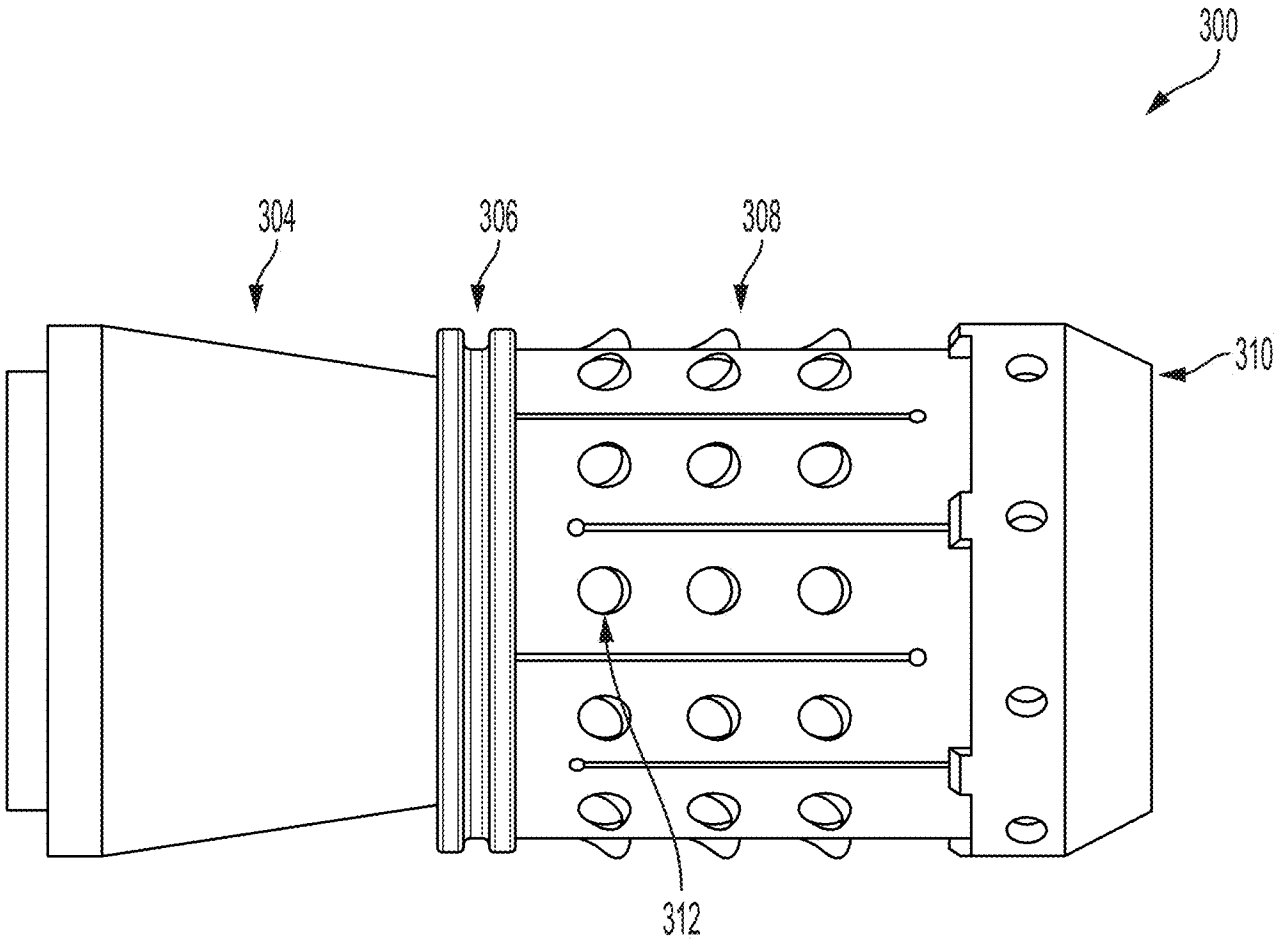
FIG. 3 is a diagrammatic representation of a degradable frac plug, according to an embodiment.
Figure 4:
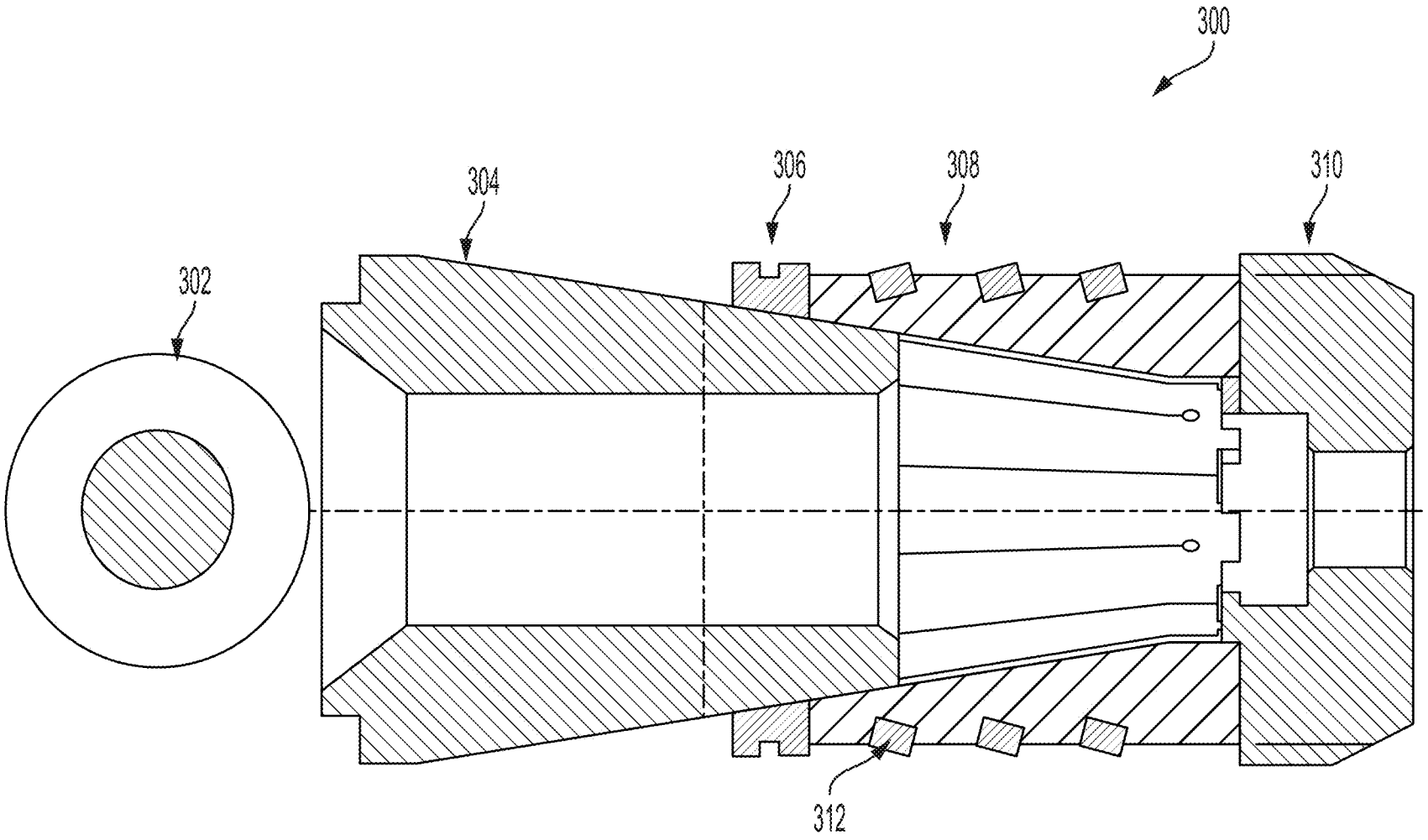
FIG. 4 is a diagrammatic representation of a degradable frac plug for use in combination with a frac ball, according to an embodiment.

FIGS. 3 and 4 are diagrammatic representations of an embodiment of a degradable frac plug 300 for use in combination with a frac ball 302. The illustrated degradable frac plug 300 includes a cone section 304, a sealing section 306, a slip section 308, and a shoe section 310. The cone section 304 of the degradable frac plug 300 is designed to connect to the wireline assembly during deployment. As such, once deployed, the cone section 304 is disposed above the other sections of the degradable frac plug 300, and the shoe section 310 is disposed below the other sections of the degradable frac plug 300, within the wellbore. During deployment, the setting tool of the wireline assembly receives a suitable control signal from the controller via the wireline to trigger an explosive charge that expands the slip section 308, such that a plurality of buttons 312 of the slip section 308 contact and engage the inner surface of the casing of the wellbore, and such that the sealing section 306 contacts and seals against the inner surface of the casing to restrict or prevent the flow of wellbore fluids in either direction. The degradable frac plug 300 is manufactured from degradable materials that predictably dissolve in a predetermined time window once exposed to the one or more chemical additives contained by the degradable delivery devices. The degradable materials may include dissolvable metals (e.g., magnesium alloys, zinc alloys, aluminum alloys) and dissolvable polymers (e.g., polylactic acid (PLA), poly (glycolic acid) (PGA)). For example, in an embodiment, the degradable frac plug 300 is predominantly formed from one or more dissolvable metals, while the buttons 312 and/or the sealing section 306 of the degradable frac plug 300 are formed from a dissolvable polymer. In various embodiments, the buttons 312 may be formed from a degradable metal, a degradable ceramic material, or a degradable polymer. It is noted that, for various fracking operations, it may be desirable for the degradable frac plug 300 to remain intact and maintain fluid isolation for minutes (e.g., 30 minutes), hours, days, or even weeks after deployment. For example, in some embodiments, it may be desirable for the degradable frac plug 300 to remain intact and maintain fluid isolation for between 30 minutes and 30 days, while in other embodiments, it may be desirable for the degradable frac plug 300 to remain intact and maintain fluid isolation for between 3 and 24 hours.

As illustrated in FIG. 4, the illustrated embodiment of the degradable frac plug 300 is activated by a frac ball 302 that is suitably sized to become lodged or sealed in the cone section 304 of the degradable frac plug 300 to block or prevent the flow of wellbore fluids through the interior of the degradable frac plug 300. As noted, in some embodiments, the frac ball 302 may be a degradable delivery device containing one or more chemical additives to promote the dissolution of the degradable frac plug 300 and/or one or more flowable sensors to measure operational conditions within the wellbore during the dissolution of the degradable frac plug 300. As discussed below, in some embodiments, such a frac ball degradable delivery device can be used in combination with other degradable delivery devices disposed within cavities of the degradable frac plug 300.

Figure 5:
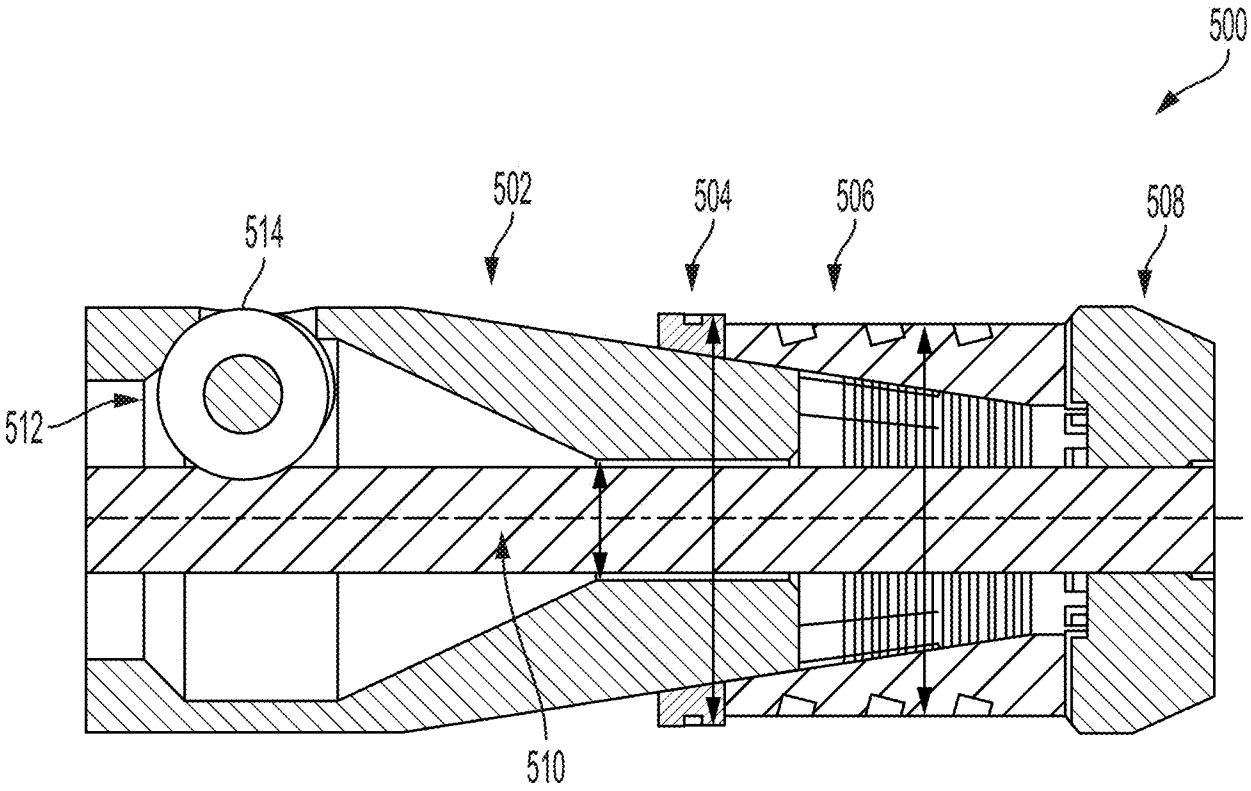
FIG. 5 is a diagrammatic representation of a degradable frac plug having a ball-in-place feature for blocking the flow of the wellbore fluid using a degradable delivery device positioned above the sealing section of the degradable frac plug, according to an embodiment.

FIG. 5 is a diagrammatic representation of another embodiment of a degradable frac plug 500. The illustrated degradable frac plug 500 includes a cone section 502, a sealing section 504, a slip section 506, and a shoe section 508, as discussed above. Unlike the embodiment of the degradable frac plug 500 illustrated in FIG. 4, the embodiment of the degradable frac plug 500 illustrated in FIG. 5 includes a ball-in-place feature that blocks or prevents the flow of wellbore fluids through the interior of the degradable frac plug 500 once deployed. For the embodiment illustrated in FIG. 5, the setting mandrel 510 is still coupled to the degradable frac plug 500 to facilitate its deployment within the wellbore. Once the setting mandrel 510 has expanded the degradable frac plug 500 and is removed from the deployed frac plug, a degradable delivery device 514 that is loaded into an interior cavity 512 defined within the cone section 502 of the degradable frac plug 500 is designed act as the ball-in-place feature, which flows into position against an opening of the internal passage of the degradable frac plug 500 to block or prevent the flow of wellbore fluids through the interior of the frac plug. The internal cavity 512 and the degradable delivery device 514 are positioned above the sealing section 504 of the degradable frac plug 500 when the frac plug is deployed within the wellbore. As such, the ball-in-place feature of the degradable frac plug 500 illustrated in FIG. 5 obviates the need for the separate frac ball 302 used by the degradable frac plug 300 of FIG. 4 to block or prevent the flow of wellbore fluids through the interior of the frac plug.

Figure 6B:
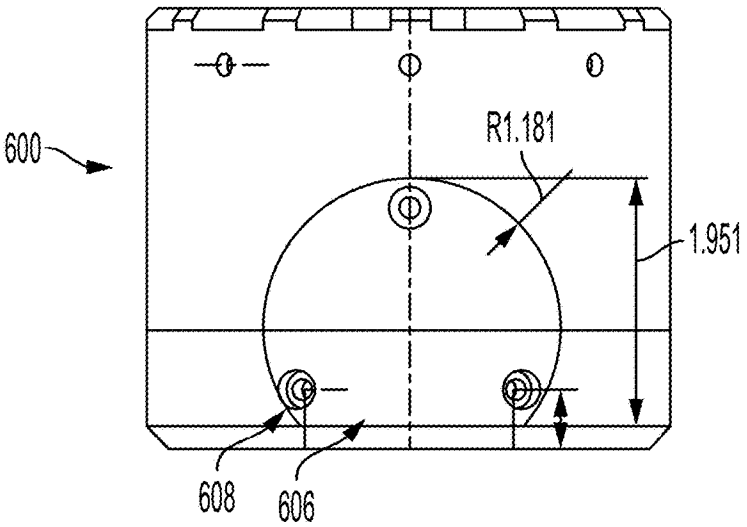
FIGS. 6A-6C are diagrammatic representations of a shoe extension of a degradable frac plug, according to an embodiment.
Figure 6A:
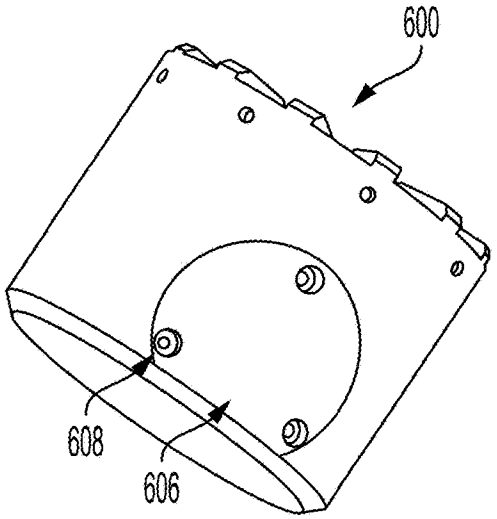
Figure 6C:
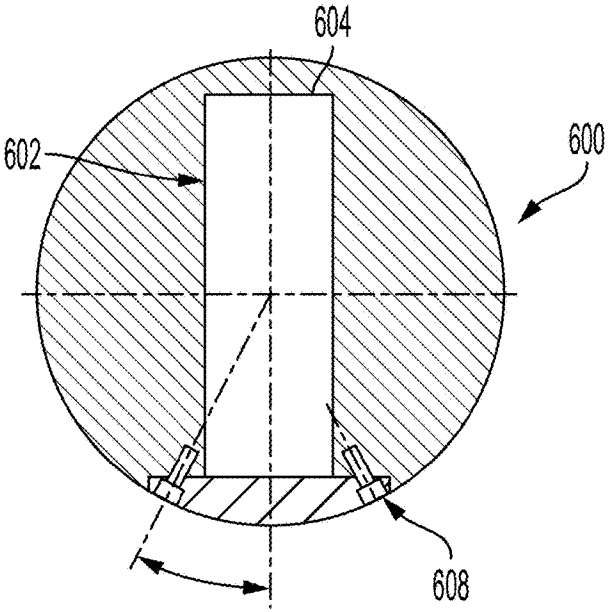

In some embodiments, the degradable frac plug may additionally or alternatively include one or more cavities disposed in one or more shoe extensions disposed below the sealing section of the degradable frac plug when the degradable frac plug is deployed within the wellbore. FIGS. 6A-6C are diagrammatic representations of an embodiment of a shoe extension 600 of a degradable frac plug. As discussed below, one or more shoe extensions 600 can be mechanically attached to the shoe section 310, 508 of the degradable frac plug. The illustrated shoe extensions 600 define a cylindrical internal cavity 602 that is loaded with a cylindrical degradable delivery device 604. While the cylindrical degradable delivery device 604 is not directly mechanically or adhesively attached to the shoe extension 600, a cover 606 is disposed over the opening of the cylindrical internal cavity 602 after the cylindrical degradable delivery device 604 has been loaded, and a plurality of screws 608 are used to mechanically attach the cover 606 to the shoe extension 600 to maintain the cylindrical degradable delivery device 604 within the internal cavity 602 prior to and during deployment of the degradable frac plug. In some embodiments, the cover 606, the screws 608, or both, are formed from a degradable material having a composition and/or dimensions that are more readily dissolved in the wellbore fluid, which enables the wellbore fluid to readily dissolve the cover 606, the screws 608, or both, to reach and dissolve the cylindrical degradable delivery device 604. As discussed below, any number of shoe extensions 600 can be connected to the distal end of the degradable frac plug, each delivering a respective degradable delivery device 604 below the sealing section 306, 504 of the degradable frac plug 300, 500.

Figure 7:
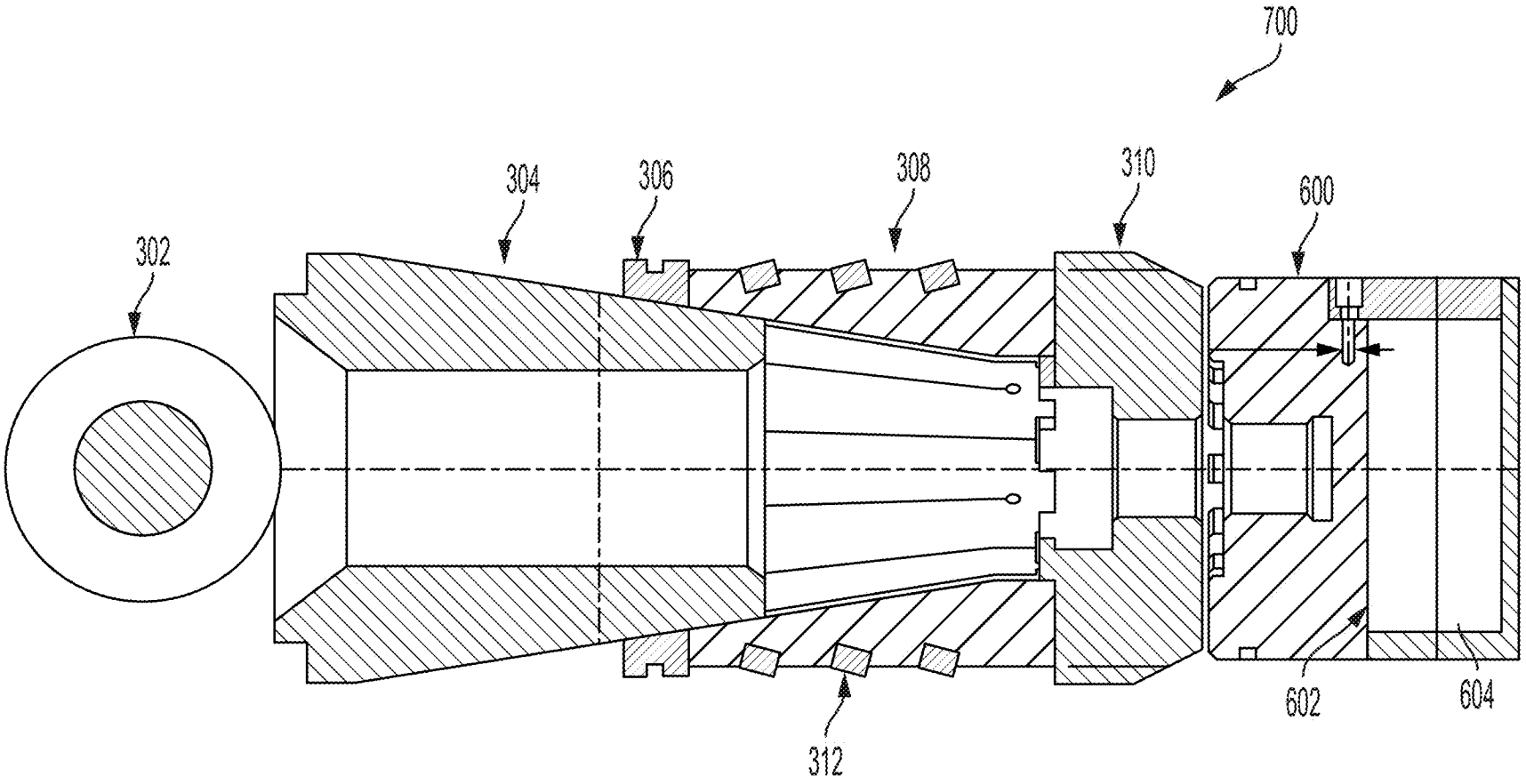
FIG. 7 is a diagrammatic representation of a degradable frac plug for use in combination with a frac ball that is a first degradable delivery device, the degradable frac plug having a second degradable delivery device positioned in a shoe extension below the sealing section of the degradable frac plug, according to an embodiment.
Figure 8:
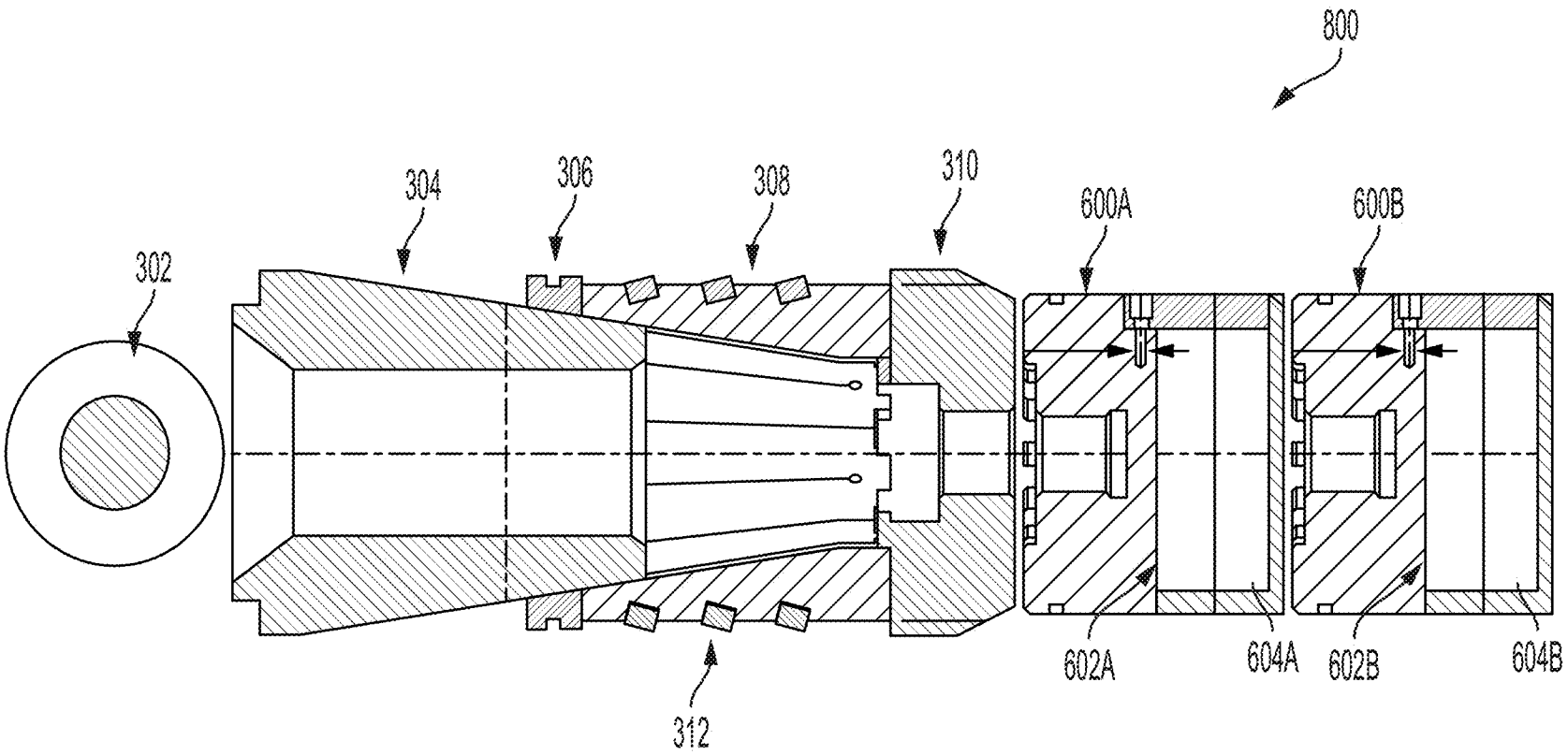
FIG. 8 is a diagrammatic representation of a degradable frac plug for use in combination with a frac ball that is a first degradable delivery device positioned above the sealing section of the degradable frac plug, the degradable frac plug further including a second degradable delivery device positioned in a first shoe extension below the sealing section of the degradable frac plug and a third degradable delivery device positioned in a second shoe extension below the sealing section of the degradable frac plug, according to an embodiment.
Figure 9:
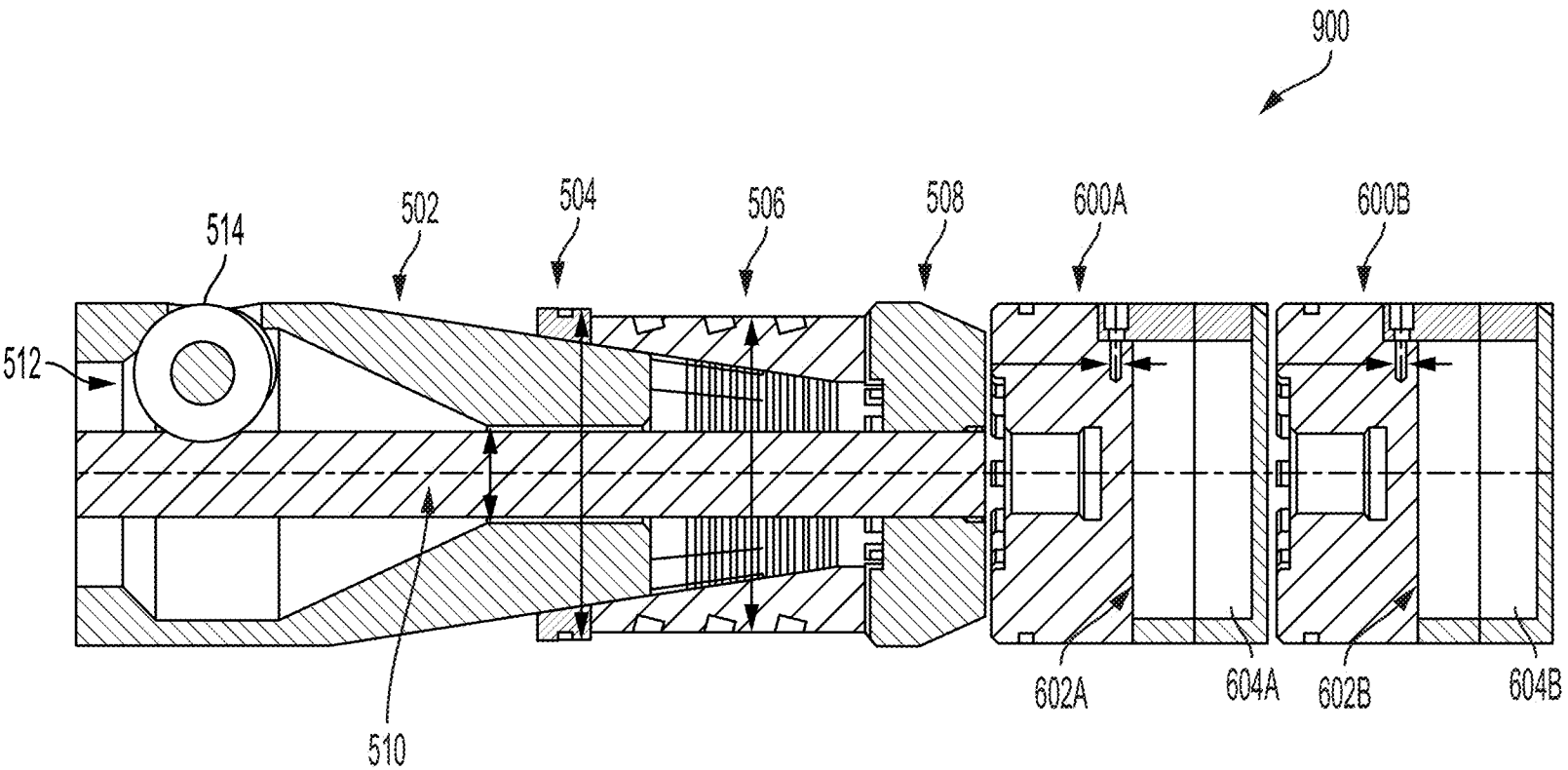
FIG. 9 is a diagrammatic representation of a degradable frac plug having a ball-in-place feature for blocking the flow of the wellbore fluid using a first degradable delivery device positioned above the sealing section of the degradable frac plug, having a second degradable delivery device positioned in a first shoe extension below the sealing section of the degradable frac plug, and having a third degradable delivery device positioned in a second shoe extension below the sealing section of the degradable frac plug, according to an embodiment.

As illustrated in FIGS. 7-9, in some embodiments, multiple degradable delivery devices can be used to deliver one or more chemical additives to facilitate dissolution of the degradable frac plug and/or to deliver one or more flowable sensors to measure operational conditions in the wellbore during dissolution of the degradable frac plug. In particular, FIG. 7 is a diagrammatic representation of an embodiment of a degradable frac plug 700 for use in combination with a frac ball 302 that is a first degradable delivery device positioned above the sealing section 306 of the degradable frac plug 700 within the wellbore. In addition, the degradable frac plug 700 illustrated in FIG. 7 also includes a second degradable delivery device 604 positioned in the internal cavity 602 of the shoe extension 600 below the sealing section 306 of the degradable frac plug 700.

FIG. 8 is a diagrammatic representation of an embodiment of a degradable frac plug 800 for use in combination with a frac ball 302 that is a first degradable delivery device positioned above the sealing section 306 of the degradable frac plug 800 within the wellbore. In addition, the degradable frac plug 800 illustrated in FIG. 8 also includes a second degradable delivery device 604A positioned in an internal cavity 602A of a first shoe extension 600A, as well as a third degradable delivery device 604B positioned in an internal cavity 602B of a second shoe extension 600B, such that the second degradable delivery device 604A and the third degradable delivery device 604B are positioned below the sealing section 306 of the degradable frac plug 800.

FIG. 9 is a diagrammatic representation of an embodiment of a degradable frac plug 900 having a ball-in-place feature, as discussed above. The illustrated degradable frac plug 900 includes a first degradable delivery device 514 (e.g., the ball-in-place) positioned in an internal cavity 512 within the cone section 502 of the degradable frac plug 900 above the sealing section 504 of the degradable frac plug 900 when deployed within the wellbore. Additionally, the illustrated degradable frac plug 900 includes a second degradable delivery device 604A positioned in an internal cavity 602A of a first shoe extension 600A, and a third degradable delivery device 604B positioned in an internal cavity 602B of a second shoe extension 600B, according to an embodiment, such that the second degradable delivery device 604A and the third degradable delivery device 604B are positioned below the sealing section 504 of the degradable frac plug 900.

As mentioned, embodiments of the degradable frac plug that include at least one degradable delivery device on each side of (i.e., above and below) the sealing section 306, 504 of the deployed frac plug within the wellbore enhance the effectiveness and flexibility of the disclosed approach. As noted, once the degradable frac plug is deployed and activated, the sealing section 306, 504 (in addition to the frac ball or ball-in-place feature) of the degradable frac plug blocks or prevents the exchange of fluids above and below the sealing section. As such, when a degradable delivery device is only disposed above or below the sealing section 306, 504, the one or more chemical additives released from the degradable delivery device must degrade the sealing section first before they are able to contact and promote dissolution of the opposite end of the degradable frac plug. In contrast, embodiments that include at least one degradable delivery device on each side of the sealing section 306, 504 are able to release the one or more chemical additives and immediately contact and begin promoting dissolution of both ends of the degradable frac plug, decreasing the time window required for the degradable frac plug to completely dissolve.

For embodiments in which one or more of the degradable delivery devices include flowable sensors, it may also be advantageous to have degradable delivery devices disposed on one or both sides of the sealing section 306, 504. For example, flowable sensors may be released by one or more degradable delivery devices positioned above the sealing section of the degradable frac plug, and because the released flowable sensors have a clear flow path to reach the surface even before the degradable frac plug has dissolved, detection of these flowable sensor may provide an indication that the dissolution of the degradable frac plug has commenced. For embodiments in which flowable sensors are released by one or more degradable delivery devices positioned below the sealing section of the degradable frac plug, the flowable sensors are unable to traverse the portion of the wellbore occupied by the degradable frac plug until after the sealing section has been sufficiently dissolved to disrupt the fluid isolation. As such, detection of these flowable sensor may provide an indication that the dissolution of the degradable frac plug is complete or has at least progressed to the point that fluid isolation has been disrupted.

Figure 10A:
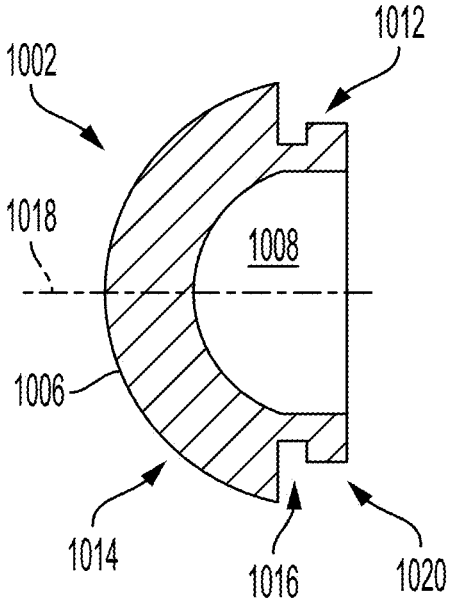
FIGS. 10A-10C are diagrammatic representations of a degradable delivery device, according to an embodiment.
Figure 10B:
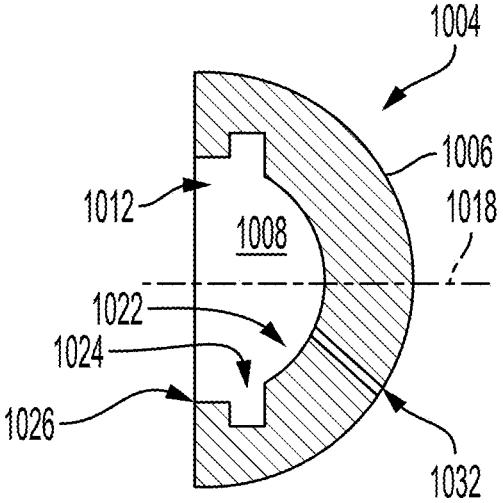
Figure 10C:
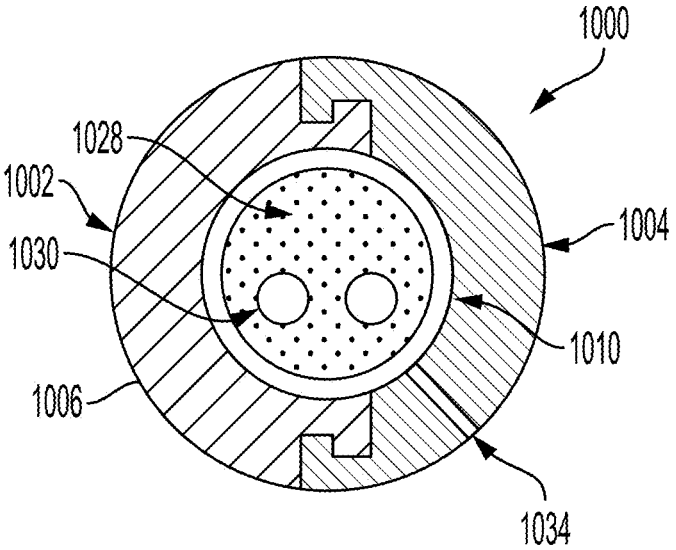

FIGS. 10A-10C are cross-sectional diagrammatic representations of an embodiment of a degradable delivery device 1000. More specifically, FIGS. 10A and 10B respectively depict a first segment 1002 and a second segment 1004 of a container 1006 of the degradable delivery device 1000, while FIG. 10C depicts the assembled container 1006 of the degradable delivery device 1000. In some embodiments, the first segment 1002 and the second segment 1004 can be coupled together using any suitable connection mechanism. For example, in some embodiments, the first segment 1002 and the second segment 1004 may each include respective threads or another suitable connection mechanism, and the segments may be connected to one another by screwing the treads or mating another suitable connection mechanism to form a complete seal. The first segment 1002 and a second segment 1004 of the container 1006 are generally hemispherical in shape and each define a hemispherical cavity 1008. When combined, the first segment 1002 and a second segment 1004 of the container 1006 form generally spherical degradable delivery device 1000 having a spherical cavity 1010 defined therein. It may be appreciated that the spherical degradable delivery device 1000 is merely illustrated as an example, and in other embodiments, the degradable delivery device 1000 may have other shapes, such as a disk shape, a cylindrical shape, an oblong shape, among others. In some embodiments, the degradable delivery device 1000 has a diameter from about 2 inches (in) or about 5.1 centimeters (cm) to about 3 inches or about 7.6 cm; however, other sizes may be used in other embodiments. The container 1006 of the degradable delivery device 1000 is made of one or more degradable materials. The degradable materials may include dissolvable metals (e.g., magnesium alloys, zinc alloys, aluminum alloys) and dissolvable polymers (e.g., polylactic acid (PLA), poly (glycolic acid) (PGA)).

For the embodiment illustrated in FIGS. 10A-10C, the first segment 1002 and a second segment 1004 of the container 1006 each include corresponding connection features 1012 designed to connect in a mating correspondence (e.g., screwing together corresponding threads or any other suitable mechanism to form a seal) to form the degradable delivery device 1000. More specifically, as illustrated in FIG. 10A, an exterior surface 1014 of the first segment 1002 of the container 1006 defines a first annular groove 1016 that is radially disposed about the axis 1018. The first annular groove 1016 of the first segment 1002 of the container 1006 defines a region of minimal thickness of the first segment 1002 of the container 1006. Additionally, the exterior surface 1014 of the first segment 1002 of the container 1006 defines a first shoulder region 1020 radially disposed about the axis 1018 and adjacent to the annular groove 1016. The thickness of the first segment 1002 of the container 1006 in the shoulder region 1020 increases slightly compared to its thickness within the annular groove 1016. As illustrated in FIG. 10B, the interior surface 1022 of the second segment 1004 of the container 1006 defines a second annular groove 1024 that is radially disposed about the axis 1018. The second annular groove 1024 of the second segment 1004 of the container 1006 defines a region of minimal thickness of the second segment 1004 of the container 1006. Additionally, the interior surface 1022 of the second segment 1004 of the container 1006 defines a second shoulder region 1026 radially disposed about the axis 1018 and adjacent to the second annular groove 1024.

Accordingly, for the embodiment illustrated in FIGS. 10A-10C, the container 1006 of the degradable delivery device 1000 is formed by connecting the corresponding connection features 1012 of the first and second segments 1002, 1004. For example, the first shoulder region 1020 of the first segment 1002 may be inserted into the second annular groove 1024 of the second segment 1004, while the second shoulder region 1026 of the second segment 1004 may be inserted into the first annular groove 1016 of the first segment 1002, securing the two segments of the container 1006 together. This embodiment merely provides one example of constructing the degradable delivery device 1000, and in other embodiments, other connection features 1012 (e.g., threads, pins, screws, etc.) may be used to connect together container segments. In some embodiments, welding and/or adhesives may be used to connect and secure the container segments 1002, 1004 together.

One or more chemical additives 1028 and/or one or more flowable sensors 1030 may be loaded into the hemispherical cavity 1008 of one or both of the first segment 1002 and the second segment 1004 of the container 1006 prior to connecting the two segments together to form the degradable delivery device 1000. In other embodiments, one or both of the segments 1002, 1004 of the container 1006 may include a fill port 1032 that enables one or more chemical additives to be flowed into the spherical cavity 1010 of the degradable delivery device 1000 after connecting the two segments together to form the degradable delivery device 1000. For such embodiments, after the fill port 1032 has been used to deliver one or more chemical additives into the spherical cavity 1010 of the degradable delivery device 1000, the fill port 1032 may be sealed mechanically (e.g., using a screw or pin), adhesively (e.g., using a polymer or elastomer 1034), or by applying a weld bead to cover the exterior opening of the fill port 1032. In some embodiments, one or more elastomer or polymer seals may be inserted between the container segments (e.g., within the first annular groove 1016, within the second annular grooves 1024, or both) to retain the contents of the degradable delivery device 1000 within the cavity 1010 until the container 1006 at least partially dissolved in the wellbore fluid.

As discussed below, the one or more chemical additives 1028 may vary depending on a number of factors, including the chemical composition of the degradable downhole tool and the chemical composition of the wellbore fluid. In general, chemical additives 1028 may include salts (e.g., chloride salts), oxidizers, acids, and/or bases (e.g., alkali chemicals). A non-limiting list of example chemical additives includes, but is not limited to: ammonium chloride ($NH_4Cl$), sodium nitrite ($NaNO_2$), citric acid, acetic acid, sodium chloride (NaCl), calcium chloride ($CaCl_2$)), magnesium chloride ($MgCl_2$), potassium chloride (KCl), or any combination thereof. The one or more chemical additives 1028 may be solid (e.g., powders, crystals), liquid, or a mixture of solids and liquid (e.g., a solution or suspension). It may be appreciated that certain chemical additives may degrade flowable sensors 1030, and as such, the flowable sensors 1030 may be advantageously delivered using a separate degradable delivery device, in some embodiments.

Figure 11:
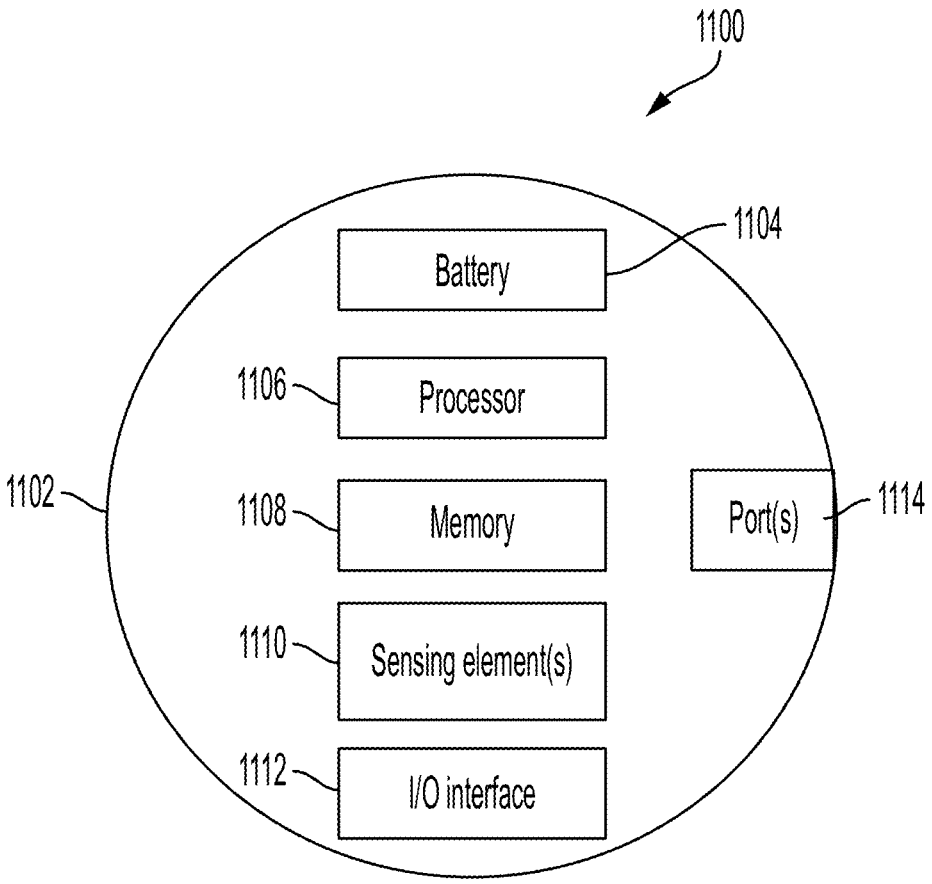
FIG. 11 is a diagrammatic representation of a flowable sensor that is delivered into the wellbore using a degradable delivery device, according to an embodiment.

FIG. 11 is a diagrammatic representation of an embodiment of a flowable sensor 1100 that is delivered into the wellbore using a degradable delivery device. While a housing 1102 of the illustrated flowable sensor 1100 is spherical, in other embodiments, the flowable sensor 1100 may have other shapes, such as a disk shape, a cylindrical shape, an oblong shape, among others, that promote low-resistance movement through the wellbore. The housing 1102 is formed from a material that is not degradable or dissolvable within the wellbore fluid. In some embodiments, the housing 1102 of the flowable sensor 1100 is made of a magnetic metal, and a magnetic field may be applied to wellbore fluids that reach the surface to magnetically retrieve the flowable sensor 1100 from the wellbore fluid. In some embodiments, the flowable sensor 1100 may be made of lower density components or may include an internal air pocket that renders the flowable sensor 1100 buoyant within the wellbore fluid, and this buoyancy causes the flowable sensor 1100 to rise within a vessel that receives the wellbore fluid to facilitate their recovery (e.g., via a skimming technique).

For the embodiment illustrated in FIG. 11, the flowable sensor 1100 includes a battery 1104 that provides power to operate the flowable sensor 1100. For example, the battery 1104 may have a suitable capacity to remain in a charged state for weeks to months prior to the flowable sensor 1100 being deployed and have a suitable capacity to operate the flowable sensor 1100 for hours to days once released from the degradable delivery device. In some embodiments, the flowable sensor 1100 may support wireless charging of the battery 1104. The flowable sensor 1100 includes at least one processor 1106 and at least one memory 1108. The processor 1106 may be a low-power or application specific processor that executes instructions stored in the memory 1108 to enable operation of the flowable sensor 1100. In addition to instructions, the memory 1108 stores measurements of operational conditions in the wellbore measured by one or more sensing elements 1110 of the flowable sensor 1100 during operation. Furthermore, for embodiments in which multiple degradable delivery devices contain respective flowable sensors, the memory 1108 stores an identifier that indicates which degradable delivery device released the flowable sensor 1100. In some embodiments, the one or more sensing elements 1110 may include a temperature sensor that measures the temperature of the wellbore fluid, a pressure sensor that measures the pressure of the wellbore fluid, and/or a pH sensor that measures the pH of the wellbore fluid, once the flowable sensor is released from the degradable delivery device. The measurements collected by the one or more sensing elements 1110 may be stored in the memory 1108 along with timestamps indicating when each measurement was taken. In some embodiments, the sensing elements 1110 may include an accelerometer that detects acceleration of the flowable sensor 1100, and this data may be stored with the other collected measurements and timestamps to enable the controller 120 to determine or estimate the movement of the flowable sensor 1100 over time and/or the position of the flowable sensor when each of the measurements were collected. In some embodiments, the one or more sensing elements or another component (e.g., an activation element) may delay activation of the flowable sensor until after it contacts the wellbore fluid, indicating it has been released from the degradable delivery device.

For the embodiment illustrated in FIG. 11, the flowable sensor 1100 also includes an input/output (I/O) interface 1112 that enables the flowable sensor 1100 to communicate with an external computing system (e.g., the controller 120). In some embodiments, the I/O interface 1112 enables wireless communication via a radio-frequency or optical communication channel. For example, in some embodiments, the I/O interface 1112 enables measurements to be received from the flowable sensor 1100 via WiFi®, Bluetooth®, or another wireless communication protocol. In some embodiments, the I/O interface 1112 enables measurements to be received from the flowable sensor 1100 via a wired connection. For example, the flowable sensor 1100 may include one or more ports 1114, which may include one or more ports for charging the battery 1104 and/or receiving measurements collected by the flowable sensor 1100 during operation. For embodiments that include the one or more ports 1114, a suitable polymeric or elastomeric cover may be placed over the ports 1114 to prevent entry of the wellbore fluids during operation.

Figure 12:
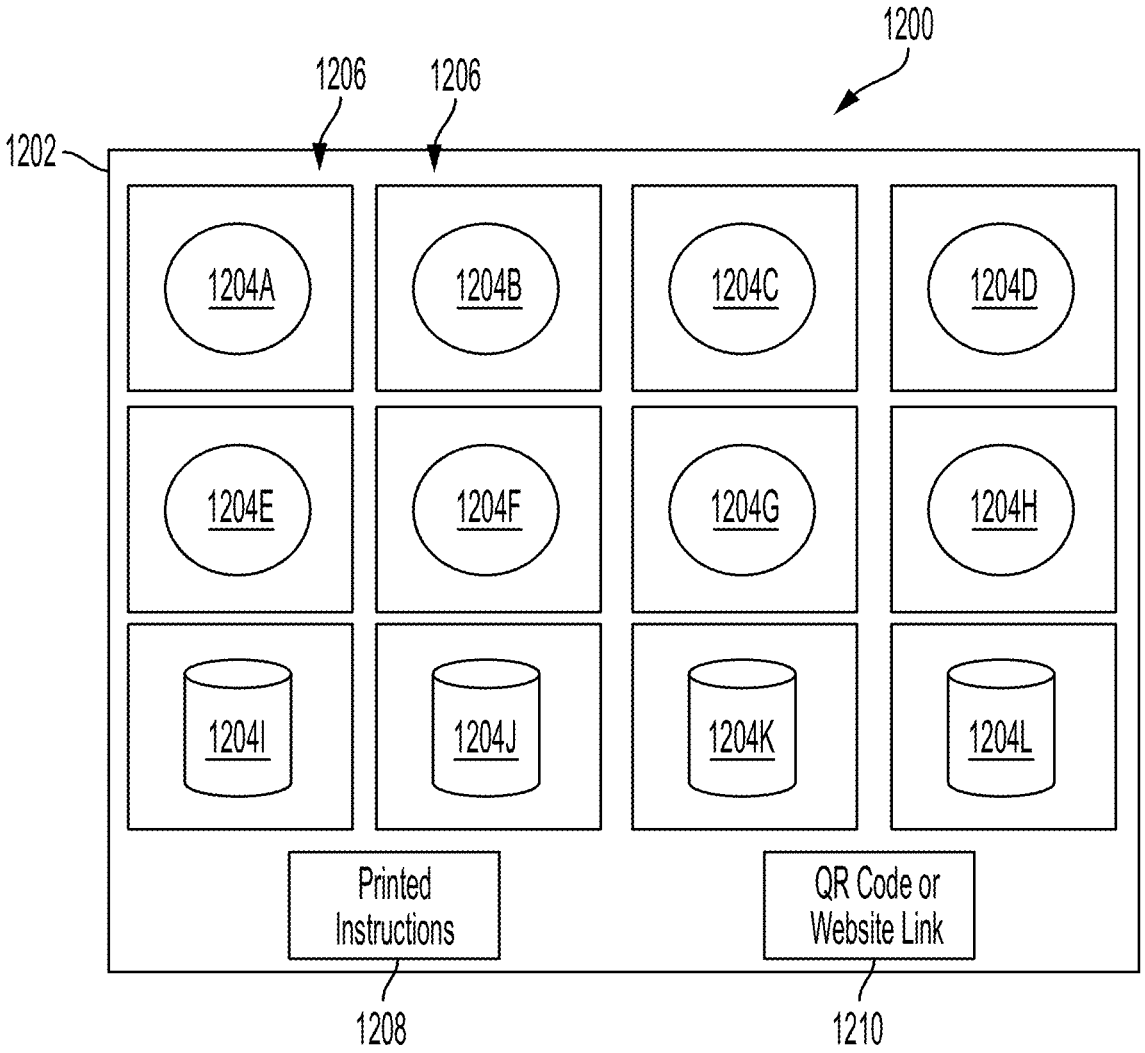
FIG. 12 is a diagrammatic representation of a downhole tool dissolution treatment kit that contains a set of degradable delivery devices, according to an embodiment.

In some situations, it may be desirable to provide a set of degradable delivery devices that can be used in combination with degradable downhole tools (e.g., a degradable frac plug), which enables an operator to select one or more degradable delivery devices for a downhole dissolution treatment of the degradable downhole tool based on different factors. For example, FIG. 12 is a diagrammatic representation of an embodiment of a downhole tool dissolution treatment kit 1200 that includes a packaging 1202 containing a set of degradable delivery devices 1204 (e.g., degradable delivery devices 1204A-L). The packaging 1202 defines a plurality of slots 1206, each containing a respective degradable delivery device. Each of the slots 1206 or each degradable delivery device is labeled, marked, or colored to indicate a respective identity of each degradable delivery device. In some embodiments, the identity of each degradable delivery device corresponds to the dimensions and chemical composition of the container the degradable device, as well as the one or more chemical additives, the one or more flowable sensors, or the combination of one or more chemical additives and one or more flowable sensors contained within each degradable delivery device. In some embodiments, each degradable delivery device of the downhole tool dissolution treatment kit 1200 contains a unique combination of the one or more chemical additives, the one or more flowable sensors, or both. In other embodiments, two or more of the degradable delivery devices contain the same one or more chemical additives loaded in the same or different amounts, the same one or more flowable sensors, or both. As such, the downhole tool dissolution treatment kit 1200 enables an operator to select one or more of the degradable delivery devices to be used to promote dissolution of the degradable downhole tool, to monitor operational conditions in the treated reservoir section during the dissolution treatment, or both, based on one or more factors specific to the downhole tool dissolution treatment.

For the embodiment illustrated in FIG. 12, the downhole tool dissolution treatment kit 1200 includes or refers to instructions to guide the operator in selecting suitable degradable delivery devices for a downhole tool dissolution treatment. For example, in some embodiments, these instructions include printed instructions 1208 that indicate which degradable delivery devices should be selected based on one or more factors specific to the dissolution treatment. Additionally or alternatively, in some embodiments, the downhole tool dissolution treatment kit 1200 includes a website link or a quick response (QR) code 1210 that can be accessed by a suitable computing device. Using either the printed instructions 1208 or the website link/QR code 1210, the operator can use one or more factors specific to the dissolution treatment to identify suitable degradable delivery devices for the downhole tool dissolution treatment. A non-limiting list of example factors specific to the downhole tool dissolution treatment include, but are not limited to: a temperature of the wellbore fluid near the downhole tool, a pressure of the wellbore near the downhole tool, a chemical composition of the downhole tool, a mode of activation (e.g., frac ball or ball-in-place) of the downhole tool, a chemical composition of the wellbore fluid, a desired dissolution time for the downhole tool, and one or more operational conditions within the wellbore to be measured during the treatment operation. In some embodiments, the operator may utilize information related to one or more of these factors to identify one or more suitable degradable delivery devices from the downhole tool dissolution treatment kit 1200 using a lookup table contained within the printed instructions. In some embodiments, the operator may provide information related to one or more of these factors as input to a website accessed via the website link/QR code 1210, and in response, receive recommendations of one or more suitable degradable delivery devices to be used in the downhole tool dissolution treatment.

Figure 13:
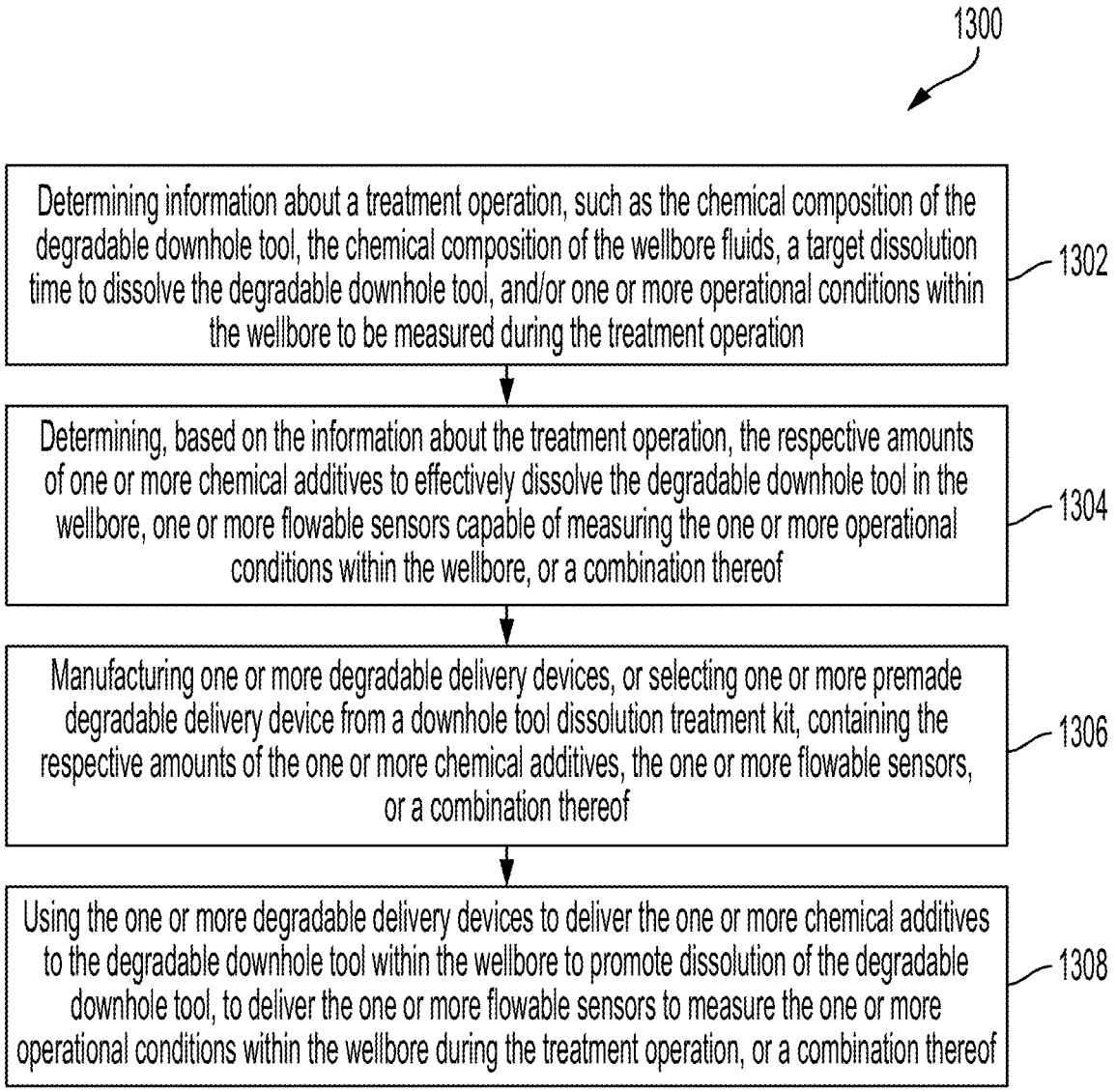
FIG. 13 is a diagrammatic representation of a method of designing a downhole tool dissolution treatment that utilizes one or more degradable delivery devices, according to an embodiment.

FIG. 13 is a diagrammatic representation of an embodiment of a method 1300 of designing a downhole tool dissolution treatment that utilizes one or more degradable delivery devices. The illustrated method 1300 is provided as an example, and in other embodiments, the method 1300 may include repeated steps, omitted steps, or steps performed in other orders. In some embodiments, at least a portion of the method 1300 may be stored as computer-implemented instructions stored in a memory and executed by a processor of one or more controllers to facilitate design and/or implementation of the downhole tool dissolution treatment.

For the embodiment illustrated in FIG. 13, the method 1300 begins with the step 1302 of determining information about the treatment operation, such as the chemical composition of the degradable downhole tool, the chemical composition of the wellbore fluids, a target dissolution time to dissolve the degradable downhole tool, one or more operational conditions within the wellbore to be measured during the treatment operation, which degradable delivery devices or downhole tool dissolution treatment kits are available for use at the worksite, and/or other relevant treatment information. In certain embodiments, some or all of the information about the treatment operation may be determined or provided by the operator. In other embodiments, at least a portion of the information about the treatment operation may be determined by the controller, based on inputs provided by the operator and/or based on measurements performed by other sensors associated with the well. For example, in some embodiments, certain information about the treatment (e.g., chemical composition of the wellbore fluid, pressure, temperature) may be determined from measurements collected by sensors (e.g., chemical analysis sensors, pressure sensors, temperature sensors) associated with the well.

For the embodiment illustrated in FIG. 13, the method 1300 continues with the step 1304 of determining, based on the information about the treatment operation, the respective amounts of one or more chemical additives to effectively dissolve the degradable downhole tool in the wellbore, one or more flowable sensors capable of measuring the one or more operational conditions within the wellbore, or a combination thereof. For example, based on the information about the treatment operation, the operator or controller may determine respective amounts of one or more chemical additives that will effectively dissolve the degradable downhole tool within the chemical and physical conditions present within the wellbore within a predetermined amount of time. Additionally, based on the information about the treatment operation, the operator or controller may determine which flowable sensors are suitable to measure the one or more operational conditions within the wellbore during the downhole tool dissolution treatment.

For the embodiment illustrated in FIG. 13, the method 1300 continues with the step 1306 of manufacturing one or more degradable delivery devices, or selecting one or more pre-made degradable delivery device from a downhole tool dissolution treatment kit, containing the respective amounts of the one or more chemical additives, the one or more flowable sensors, or a combination thereof. For example, in some embodiments, the containers of one or more degradable delivery devices may be constructed and loaded, as discussed above, with the respective amounts of the one or more chemical additives and/or the one or more flowable sensors (as determined in step 1304) just prior to deployment. This approach advantageously enables the one or more chemical additives to be stored separately from one another and separate from the container of the degradable delivery devices, until just prior to deployment, which may prevent premature reaction or degradation of the chemical additives and/or the container of the degradable delivery devices prior to deployment. This approach may further enable the one or more flowable sensors, when present, to be accessible for testing and charging until just prior to deployment, ensuring that the flowable sensors have adequate battery power before being deployed. However, in some cases, the worksite may not have the proper equipment or personnel to assemble the degradable delivery devices onsite. For such cases, the operator or controller may instead select one or more pre-made degradable delivery devices from a downhole tool dissolution treatment kit that are pre-loaded with the respective amounts of the one or more chemical additives, the one or more flowable sensors, or both, which desirably reduces the equipment, personnel, and/or time required to prepare the degradable delivery devices for deployment.

For the embodiment illustrated in FIG. 13, the method 1300 concludes with the step 1308 of using the one or more degradable delivery devices to deliver the one or more chemical additives to the degradable downhole tool within the wellbore to promote dissolution of the degradable downhole tool, to deliver the one or more flowable sensors to measure the one or more operational conditions within the wellbore during the treatment operation, or a combination thereof. For example, deploying the degradable delivery devices may include loading one or more degradable delivery devices into respective cavities of the downhole tool prior to deployment within the wellbore. In some embodiments, deploying the degradable delivery devices may include flowing a frac ball that is a degradable delivery device into position against a deployed degradable frac plug. In certain embodiments, deploying the degradable delivery devices may include loading one or more degradable delivery devices into respective cavities of the downhole tool prior to deployment within the wellbore and also flowing a frac ball that is a degradable delivery device into position against a deployed degradable frac plug. For example, in some embodiments, one or more degradable delivery devices are deployed above at least a portion (e.g., a sealing section) of the degradable downhole tool, and one or more degradable delivery devices are deployed below at least a portion (e.g., a sealing section) of the degradable downhole tool within the wellbore.

Figure 14:
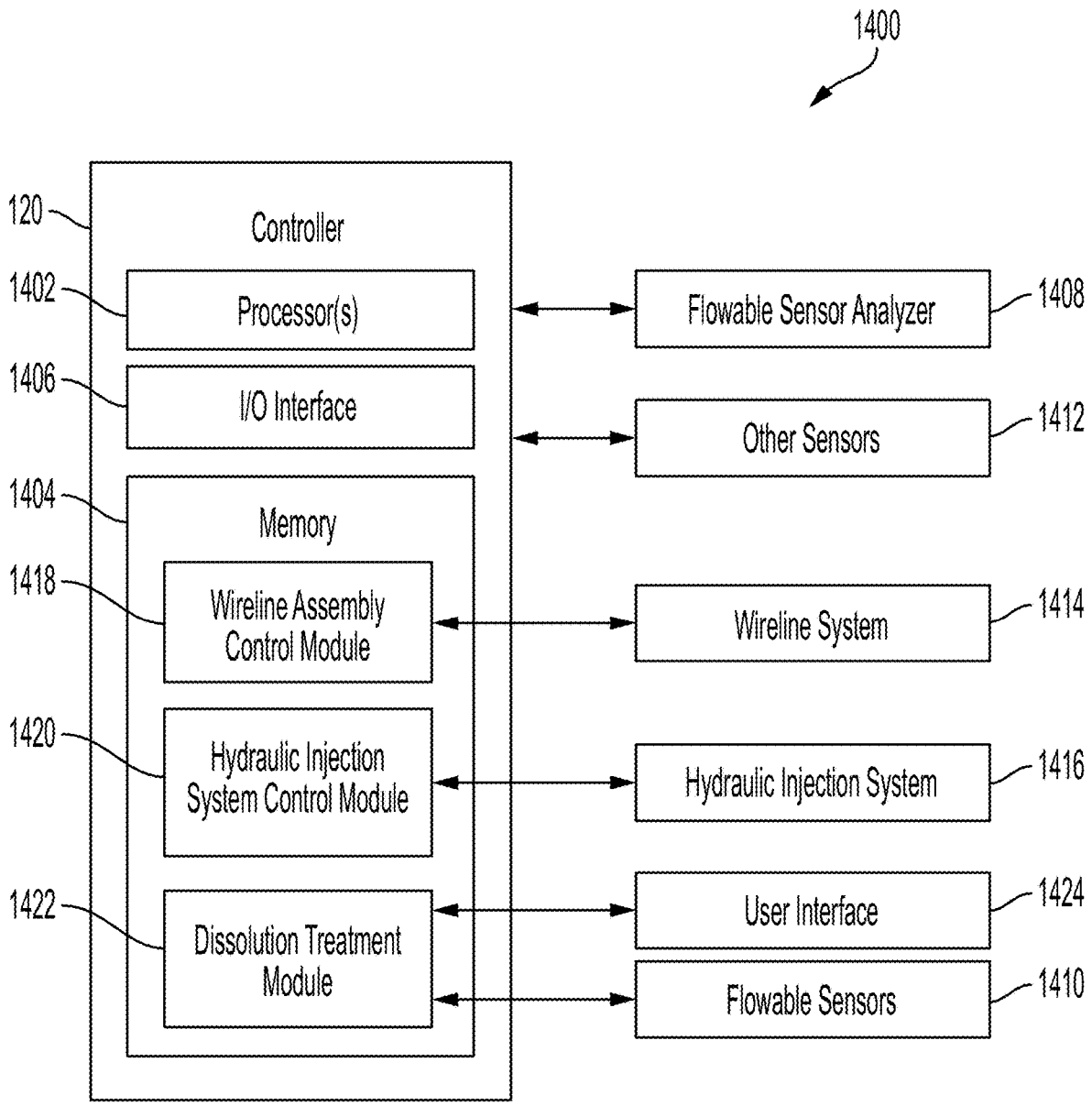
FIG. 14 is a diagrammatic representation of a control system associated with the hydraulic fracturing operation that includes a downhole tool dissolution treatment, according to an embodiment.

FIG. 14 is a diagrammatic representation of an embodiment of a control system 1400 associated with the hydraulic fracturing operation that includes a downhole tool dissolution treatment. In some examples, the control system 1400 includes a controller 120 or one or more controllers. While described herein as a controller, it may be appreciated that, in other embodiments, the controller may be or include any suitable computing system, such as a desktop, laptop, or tablet computing device. Additionally, while the control system 1400 is illustrated and described as including a single controller 120, in some embodiments, the operation of the controller may instead be implemented using a collection of controllers in signal communication with one another.

The controller 120 of various examples disclosed herein includes one or more processors, such as processor 1402, as well as a memory or machine-readable storage medium, such as memory 1404. As used herein, a "machine-readable storage medium" may be any electronic, magnetic, optical, or other physical storage apparatus to contain or store information such as executable instructions, data, and the like. For example, any machine-readable storage medium described herein may be any of random-access memory (RAM), volatile memory, non-volatile memory, flash memory, a storage drive, a hard drive, a solid-state drive, any type of storage disc, and the like, or a combination thereof. The memory 1404 stores or includes instructions executable by the processor 1402. As used herein, a "processor" includes, for example, one processor or multiple processors included in a single device or distributed across multiple computing devices. The processor 1402 may be at least one of a central processing unit (CPU), a semiconductor-based microprocessor, a graphics processing unit (GPU), a field-programmable gate array (FPGA) to retrieve and execute instructions, a real-time processor (RTP), other electronic circuitry suitable for the retrieval and execution instructions stored on a machine-readable storage medium, or a combination thereof.

The controller 120 includes an I/O interface 1406 that enables the controller 120 to be in signal communication with other components associated with the completion of the oil and gas well. For example, these components may include a flowable sensor analyzer 1408 that extracts measurements collected by the flowable sensors 1410. In some embodiments, the flowable sensors 1410 may provide the measurements directly to the controller 120. The components may also include other sensors 1412 (e.g., pressure, temperature, flow, chemical composition, displacement, and/or vibration sensors) that are associated with the completion of the oil and gas well. In some embodiments, the controller 120 is in signal communication with a wireline system 1414 and a hydraulic injection system 1416, as discussed above, to control and/or monitor the operation of these system either directly or acting as a primary controller to respective secondary controllers of these systems. As used herein, "signal communication" refers to electric communication such as hard wiring two components together or wireless communication, as understood by those skilled in the art. For example, wireless communication may be Wi-Fi®, Bluetooth®, ZigBee, or forms of near field communications. In addition, signal communication may include one or more intermediate controllers or relays disposed between elements that are in signal communication with one another. In the drawings and specification, several examples of systems and methods of operating an oil and gas well through various stages of completion are disclosed.

The memory 1404 of the controller 120 includes instructions executed by the processor 1402 to facilitate completion of an oil and gas well according to the examples disclosed herein. For the illustrated embodiment, these instructions include instructions of a wireline assembly control module 1418 that controls and monitors operation of the wireline system 1414. The instructions of the wireline assembly control module 1418 include instructions to provide control signals to lower the wireline assembly into the wellbore, to deploy the degradable frac plug at a desired location within the wellbore to isolate a section of the wellbore, to perforate the isolated section of the wellbore, and to raise the wireline assembly from the wellbore. For the illustrated embodiment, these instructions also include instructions of a hydraulic injection system control module 1420 that controls and monitors operation of the hydraulic injection system 1416. The instructions of the hydraulic injection system control module 1420 include instructions to activate components (e.g., valves, pumps, etc.) of the hydraulic injection system 1416 to inject hydraulic fluid and proppant into the wellbore to hydraulically fracture the isolated section of the wellbore, and to deactivate the hydraulic injection system 1416 once the hydraulic fracturing operation is complete.

For the illustrated embodiment, the instructions stored within the memory 1404 of the controller 120 include instructions of a dissolution treatment module 1422. For example, these instructions may include instructions to monitor the operational conditions within the wellbore (e.g., the treated reservoir section) and/or control operational parameters of the well based on the one or more operational conditions measured by the flowable sensors 1410 during a downhole tool dissolution treatment operation, as discussed above with respect to step 214 of the method 200 illustrated in FIG. 2. These instructions may include instructions to design a downhole tool dissolution treatment in accordance with steps 1302, 1304, and 1306 of the method 1300 illustrated in FIG. 13. For example, the controller 120 may determine the information about the treatment operation from inputs received from the operator via the user interface 1424 and/or from sensors 1412 monitoring aspects of the oil and gas well during completion. Using this information, along with other stored data regarding which chemical additives are most effective to dissolve the particular degradable materials of the degradable downhole tool within the particular chemical environment afforded by the wellbore fluid, the controller 120 may determine the respective amounts of the one or more chemical additives to be used to effectively dissolve the degradable downhole tool within a desired time window. In some embodiments, the other stored data may be in the form of a model (e.g., an artificial neural network model) that was previously trained using experimental data collected in field trails. The controller 120 may provide output via the user interface 1424 indicating which chemical additives and/or flowable sensors should be loaded into which containers to manufacture these degradable delivery devices on-site, or indicating which premade degradable delivery devices should be selected from a downhole tool dissolution treatment kit 1200. Additionally, the output may indicate how each of the degradable delivery devices should be used in the treatment operation, such as being flowed down to the deployed degradable frac plug as a frac ball degradable delivery device, loaded into an internal cavity above a sealing section of a degradable frac plug prior to deployment, or loaded into an internal cavity below a sealing section of a degradable frac plug (e.g., in a shoe extension) prior to deployment.

Figure 15:
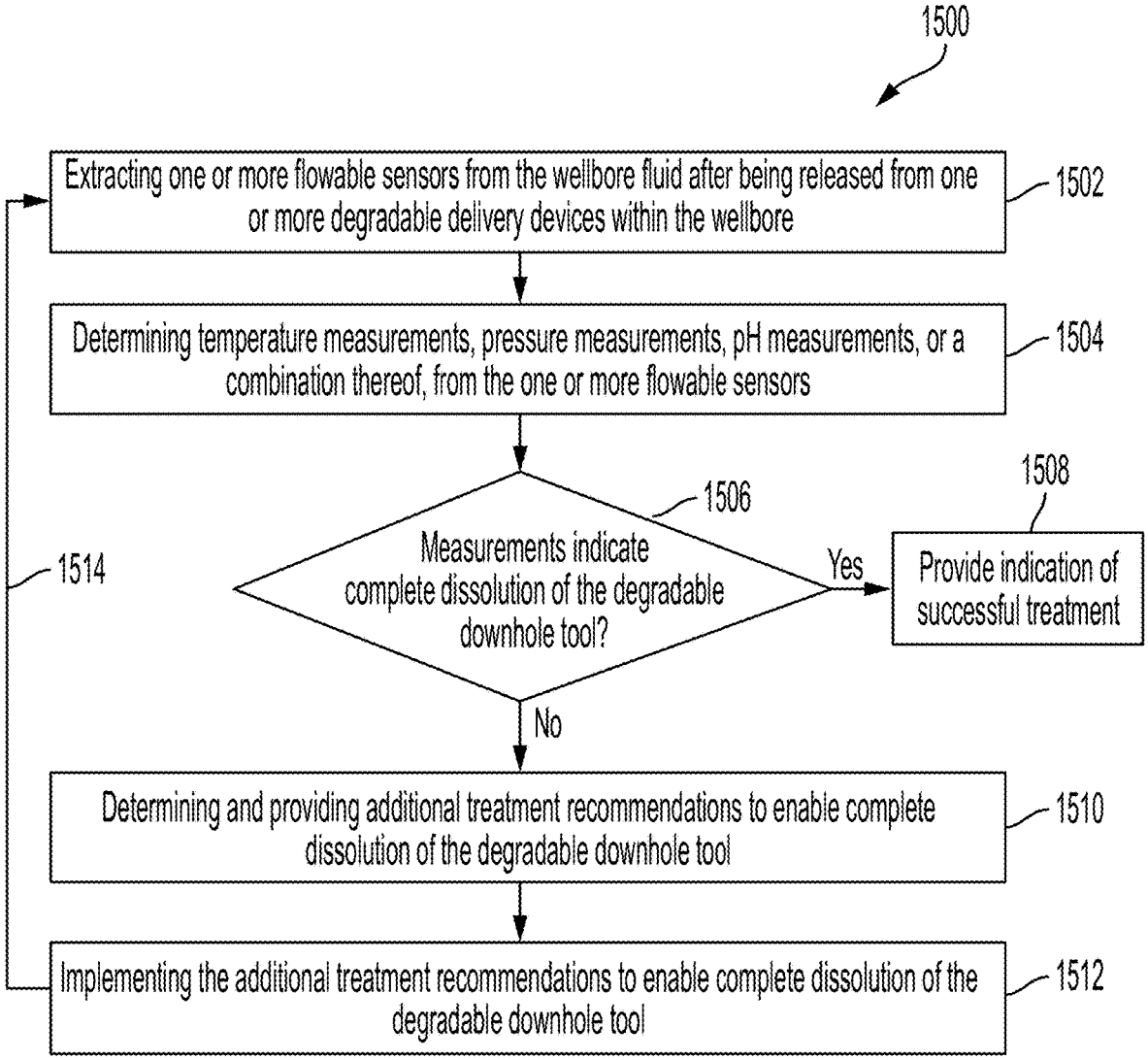
FIG. 15 is a diagrammatic representation of a method of whereby the controller monitors and/or controls a downhole tool dissolution treatment, according to an embodiment.

FIG. 15 is a diagrammatic representation of an embodiment of a method 1500 of whereby the dissolution treatment module 1422 of the controller 120 monitors and/or controls a downhole tool dissolution treatment. The illustrated method 1500 is provided as an example, and in other embodiments, the method 1500 may include repeated steps, omitted steps, or steps performed in other orders. In some embodiments, the method 1500 may be stored as computer-implemented instructions in the memory 1404 and executed by the processor 1402 of the controller 120 to facilitate implementation of the downhole tool dissolution treatment.

For the embodiment illustrated in FIG. 15, the method 1500 begins with the step 1502 of extracting one or more flowable sensors from the wellbore fluid after being released from one or more degradable delivery devices within the wellbore. For example, the flowable sensors may be extracted from the wellbore fluid by the flowable sensor analyzer 136, as discussed above with respect to FIG. 1D. In other embodiments, the flowable sensors may be recovered manually by an operator and the measurements provided to the controller 120. As noted, in some embodiments, the flowable sensors may be magnetic or buoyant to facilitate their automatic or manual extraction from the wellbore fluid.

For the embodiment illustrated in FIG. 15, the method 1500 continues with the step 1504 of determining temperature measurements, pressure measurements, pH measurements, or a combination thereof, from the one or more flowable sensors 1410. For example, in some embodiments, the measurement data collected by the flowable sensors may be extracted by the flowable sensor analyzer 136 and provided to the communicatively connected controller 120. In some embodiments, the flowable sensors may be manually recovered and communicatively coupled to the controller 120 via a suitable wired or wireless communication channel to provide the measurement data to the controller for analysis. Additionally, the controller 120 may identify trends in the measurement data, such as increases or decreases in temperature, pressure, and/or pH over time. For example, in an embodiment, the controller 120 may use the timestamped measurement data, including acceleration or movement data, collected by the flowable sensor to identify which measurements are most relevant to monitoring the downhole tool dissolution treatment process, such as temperature, pressure, and/or pH measurements collected near the degradable downhole tool, and then use these measurements to identify trends. For such embodiments, temperature, pressure, and/or pH measurements collected farther away from the degradable downhole tool (e.g., as the flowable sensor is carried out of the wellbore by the wellbore fluid) may be discarded or used for other monitoring and evaluation purposes.

For the embodiment illustrated in FIG. 15, the method 1500 continues with the step 1506 of determining whether the temperature measurements, pressure measurements, pH measurements indicate complete dissolution of the degradable downhole tool. For example, the controller 120 may identify one or more trends that indicate the status of the downhole tool dissolution treatment, such as whether the treatment failed to start, is still underway, or has successfully completed. For example, the controller 120 may determine that the temperature of the wellbore fluid near the degradable downhole tool failed to increase or matches the temperature of the wellbore fluid in other portions of the wellbore, that the pressure of the of the wellbore fluid near the degradable downhole tool failed to decrease, and/or that the pH of the wellbore fluid failed to increase or decrease (depending on the nature of one or more chemical additives delivered by the degradable delivery device) as indications that the downhole tool dissolution treatment process is failed to start. The controller 120 may determine that the temperature of the wellbore fluid near the degradable downhole tool is increasing, that the pressure of the of the wellbore fluid near the degradable downhole tool is decreasing, and/or that the pH of the wellbore fluid is either increasing or decreasing (depending on the nature of one or more chemical additives delivered by the degradable delivery device) as indications that the downhole tool dissolution treatment process is still underway. The controller 120 may determine the temperature of the wellbore fluid near the degradable downhole tool has peaked and is now decreasing, that the pressure of the of the wellbore fluid near the degradable downhole tool is no longer decreasing or matches the pressure of the wellbore fluid in other portions of the wellbore, and/or that the pH of the wellbore fluid is either has peaked or reached its nadir (depending on the nature of one or more chemical additives delivered by the degradable delivery device) and now matches the pH of the wellbore fluid in other portions of the wellbore, as indications that the downhole tool dissolution treatment is complete. Responsive to the controller 120 determining that the measurements are indicative of complete dissolution of the degradable downhole tool, the controller 120 may respond by providing an indication of successful treatment via the user interface 1424.

For the embodiment illustrated in FIG. 15, responsive to the controller 120 determining that the measurements are indicative that the degradable downhole tool has not completely dissolved, the controller 120 proceed to the step 1510 of determining and providing, via the user interface 1424, additional treatment recommendations to enable complete dissolution of the degradable downhole tool. For example, the controller 120 may determine, based on the analysis of the temperature, pressure, and/or pH measurements, that the dissolution of the degradable downhole tool is proceeding as intended and provide additional treatment recommendations indicating that no further actions are necessary, apart from waiting for the conclusion predetermined time window of the downhole tool dissolution treatment to complete. In another example, the controller 120 may determine, based on the analysis of the temperature, pressure, and/or pH measurements, that the downhole tool dissolution treatment failed to adequately start or is taking too long, and provide additional treatment recommendations indicating which additional degradable delivery devices (e.g., from a downhole tool dissolution treatment kit 1200) may be flowed into position near the degradable downhole tool to promote complete dissolution.

For the embodiment illustrated in FIG. 15, the method 1500 continues with the step 1512 of implementing the additional treatment recommendations to enable complete dissolution of the degradable downhole tool. For example, based on the additional treatment recommendations provide by the controller 120, an operator may wait additional time for a downhole tool dissolution treatment that is still underway to complete. For situations in which the controller 120 determines that the downhole tool dissolution treatment failed to start or is taking too long, based on the additional treatment recommendations provide by the controller 120, an operator may flow additional degradable delivery devices into the wellbore near the degradable downhole tool to promote its complete dissolution. In some embodiments, when one or more additional degradable delivery devices are provided into the wellbore, at least one of the additional degradable delivery devices may contain and delivery additional flowable sensors that collect additional temperature, pressure, and/or pH measurements to track the continued progress of the downhole tool dissolution treatment. As indicated by the arrow 1514, after implementing the additional treatment recommendations, the method 1500 returns to the step 1502 of extracting one or more flowable sensors from the wellbore fluid to continue monitoring the progress of the downhole tool dissolution treatment. As noted, each of the flowable sensors includes or stores identifying information indicating the degradable delivery device from which it was released, which enables the controller 120 to discern flowable sensors released from initially-provided degradable delivery devices (e.g., degradable delivery devices loaded into one or more cavities of the degradable downhole tool, a frac ball degradable delivery device flowed into the wellbore to activate the degradable downhole tool) from the additional degradable delivery devices that may be introduced into the wellbore in step 1512.

This application claims priority to, and the benefit of U.S. Provisional Application No. 63/655,012, filed Jun. 2, 2024, titled "DEGRADABLE DELIVERY DEVICES TO FACILITATE DISSOLUTION OF DEGRADABLE DOWNHOLE TOOLS," the disclosure of which is incorporated herein by reference in its entirety.

Other objects, features, and advantages of the disclosure will become apparent from the foregoing figures, detailed description, and examples. It should be understood, however, that the figures, detailed description, and examples, while indicating specific embodiments of the disclosure, are given by way of illustration only and are not meant to be limiting. Additionally, it is contemplated that changes and modifications within the spirit and scope of the disclosure will become apparent to those skilled in the art from the detailed description. In further embodiments, features from specific embodiments may be combined with features from other embodiments. For example, features from one embodiment may be combined with features from any of the other embodiments. In further embodiments, additional features may be added to the specific embodiments described herein.

What is claimed is:

1. A system comprising:

a wireline assembly including a wireline, one or more perforation guns, and a setting tool, the wireline assembly communicatively connected to a controller;

a degradable frac plug removably connected to the setting tool of the wireline assembly, the degradable frac plug including:

a first degradable delivery device disposed within a first cavity of the degradable frac plug without adhesive attachment to the degradable frac plug, the first degradable delivery device configured to dissolve in a wellbore fluid to release a first amount of a first one or more chemical additives that promote dissolution of the degradable frac plug, and a second degradable delivery device disposed within a second cavity of the degradable frac plug without mechanical or adhesive attachment to the degradable frac plug, the second degradable delivery device configured to dissolve in the wellbore fluid to release a second amount of a second one or more chemical additives that further promote the dissolution of the degradable frac plug, and the first degradable delivery device, the second degradable delivery device, or both, being configured to release one or more flowable sensors configured to measure a temperature, a pressure, or both, within a treated reservoir section during a treatment operation; and the controller having a processor configured to receive the measured temperature, the measured pressure, or both, determined by the one or more flowable sensors while monitoring operational conditions within the treated reservoir section during the treatment operation.

2. The system of claim 1, wherein the first cavity is disposed above a sealing section of the degradable frac plug and the second cavity is disposed below the sealing section of the degradable frac plug when the degradable frac plug is deployed in a wellbore.

3. The system of claim 1, wherein the first degradable delivery device is spherical, and wherein the second degradable delivery device is cylindrical.

4. The system of claim 1, wherein the first degradable delivery device is disposed within the first cavity in a cone section of the degradable frac plug, and wherein the second degradable delivery device is disposed within the second cavity in a shoe extension of the degradable frac plug.

5. The system of claim 1, further comprising a degradable cover to cover the second cavity and maintain the second degradable delivery device within the second cavity after loading, the degradable cover configured to dissolve in the wellbore fluid such that the wellbore fluid reaches and dissolves the second degradable delivery device to release the second one or more chemical additives.

6. The system of claim 1, wherein the degradable frac plug comprises a metallic shoe connected to a metallic slip and a metallic cone, and the metallic slip contains a plurality of buttons, the plurality of buttons formed from a degradable metal, a degradable ceramic material, or a degradable polymeric material.

7. The system of claim 1, wherein the first degradable delivery device, the second degradable delivery device, or both, contain the one or more flowable sensors configured to detect temperature or pressure of the wellbore fluid.

8. The system of claim 1, wherein each flowable sensor of the one or more flowable sensors comprises:

a battery to power the flowable sensor, at least one sensing element configured to measure the temperature, the pressure, or both, within the treated reservoir section during the treatment operation, a memory configured to store the measured temperature, the measured pressure, or both, and an input/output (I/O) interface configured to provide the measured temperature, the measured pressure, or both, to the controller after the flowable sensor has been extracted from the treated reservoir section.

9. The system of claim 1, wherein the controller is configured to adjust an operational parameter of a well associated with the treated reservoir section based at least in part on the measured temperature, the measured pressure, or both, determined by the one or more flowable sensors.

10. A system comprising:

a wireline assembly including a wireline, one or more perforation guns, and a setting tool, the wireline assembly communicatively connected to a controller;

a degradable frac plug removably connected to the setting tool of the wireline assembly, the degradable frac plug including:

a first degradable delivery device disposed within a first cavity of the degradable frac plug without adhesive attachment to the degradable frac plug, the first degradable delivery device configured to dissolve in a wellbore fluid to release a first amount of a first one or more chemical additives that promote dissolution of the degradable frac plug, and a second degradable delivery device disposed within a second cavity of the degradable frac plug without mechanical or adhesive attachment to the degradable frac plug, the second degradable delivery device configured to dissolve in the wellbore fluid to release a second amount of a second one or more chemical additives that further promote the dissolution of the degradable frac plug, and the first degradable delivery device, the second degradable delivery device, or both, being configured to release one or more flowable sensors configured to measure a temperature, a pressure, or both, within a treated reservoir section during a treatment operation, the flowable sensors including:

a battery to power the flowable sensor, at least one sensing element configured to measure the temperature, the pressure, or both, within the treated reservoir section during the treatment operation, a memory configured to store the measured temperature, the measured pressure, or both, and an input/output (I/O) interface configured to provide the measured temperature, the measured pressure, or both, to the controller after the flowable sensor has been extracted from the treated reservoir section; and the controller (a) having a processor configured to receive the measured temperature, the measured pressure, or both, determined by the one or more flowable sensors while monitoring operational conditions within the treated reservoir section during the treatment operation and (b) configured to adjust an operational parameter of a well associated with the treated reservoir section based at least in part on the measured temperature, the measured pressure, or both, determined by the one or more flowable sensors.

11. The system of claim 10, wherein the first cavity is disposed above a sealing section of the degradable frac plug and the second cavity is disposed below the sealing section of the degradable frac plug when the degradable frac plug is deployed in a wellbore.

12. The system of claim 10, wherein the first degradable delivery device is spherical, and wherein the second degradable delivery device is cylindrical.

13. The system of claim 10, wherein the first degradable delivery device is disposed within the first cavity in a cone section of the degradable frac plug, and wherein the second degradable delivery device is disposed within the second cavity in a shoe extension of the degradable frac plug.

14. The system of claim 10, further comprising a degradable cover to cover the second cavity and maintain the second degradable delivery device within the second cavity after loading, the degradable cover configured to dissolve in the wellbore fluid such that the wellbore fluid reaches and dissolves the second degradable delivery device to release the second one or more chemical additives.

15. The system of claim 10, wherein the degradable frac plug comprises a metallic shoe connected to a metallic slip and a metallic cone, and the metallic slip and the metallic shoe contain a plurality of buttons, the plurality of buttons formed from a degradable metal, a degradable ceramic material, or a degradable polymeric material.

16. The system of claim 10, wherein the first degradable delivery device, the second degradable delivery device, or both, contain the one or more flowable sensors configured to detect temperature or pressure of the wellbore fluid.

17. A system comprising:

a wireline assembly including a wireline, one or more perforation guns, and a setting tool, the wireline assembly communicatively connected to a controller;

a degradable frac plug removably connected to the setting tool of the wireline assembly, the degradable frac plug including a metallic shoe connected to a metallic slip, the metallic slip and the metallic shoe contain a plurality of buttons, the plurality of buttons comprising one or more of a degradable metal, a degradable ceramic material, or a degradable polymeric material, the degradable frac plug also including:

a first degradable delivery device disposed within a first cavity of the degradable frac plug without adhesive attachment to the degradable frac plug, the first degradable delivery device configured to dissolve in a wellbore fluid to release a first amount of a first one or more chemical additives that promote dissolution of the degradable frac plug, and a second degradable delivery device disposed within a second cavity of the degradable frac plug without mechanical or adhesive attachment to the degradable frac plug, the second degradable delivery device configured to dissolve in the wellbore fluid to release a second amount of a second one or more chemical additives that further promote the dissolution of the degradable frac plug, the first degradable delivery device, the second degradable delivery device, or both, being configured to release one or more flowable sensors configured to measure a temperature, a pressure, or both, within a treated reservoir section during a treatment operation, the first cavity disposed above a sealing section of the degradable frac plug and the second cavity disposed below the sealing section of the degradable frac plug when the degradable frac plug is deployed in a wellbore; and the controller having a processor configured to receive the measured temperature, the measured pressure, or both, determined by the one or more flowable sensors while monitoring operational conditions within the treated reservoir section during the treatment operation.

18. The system of claim 17, wherein the first degradable delivery device is spherical, and wherein the second degradable delivery device is cylindrical.

19. The system of claim 17, wherein the first degradable delivery device is disposed within the first cavity in a cone section of the degradable frac plug, and wherein the second degradable delivery device is disposed within the second cavity in a shoe extension of the degradable frac plug.

20. The system of claim 17, further comprising a degradable cover to cover the second cavity and maintain the second degradable delivery device within the second cavity after loading, the degradable cover configured to dissolve in the wellbore fluid such that the wellbore fluid reaches and dissolves the second degradable delivery device to release the second one or more chemical additives.

* * * * *